US008408530B2

(12) United States Patent
Toda et al.

(10) Patent No.: US 8,408,530 B2
(45) Date of Patent: Apr. 2, 2013

(54) BOOKBINDING SYSTEM WITH CONTROLLED TRIMMING UNIT

(75) Inventors: Masayuki Toda, Yokohama (JP); Kiyoshi Tokashiki, Yokohama (JP); Kazuhiko Ushiyama, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/492,270

(22) Filed: Jun. 8, 2012

(65) Prior Publication Data

US 2012/0243961 A1 Sep. 27, 2012

Related U.S. Application Data

(62) Division of application No. 12/194,321, filed on Aug. 19, 2008, now Pat. No. 8,292,284.

(30) Foreign Application Priority Data

Aug. 20, 2007 (JP) ..... 2007-213842

(51) Int. Cl.
*B65H 37/06* (2006.01)

(52) U.S. Cl. ..... 270/58.07; 270/52.17; 270/32; 270/37

(58) Field of Classification Search ..... 270/32, 270/37, 52.17, 58.07, 58.08, 58.09, 58.11, 270/58.12, 58.13
See application file for complete search history.

(56) References Cited

U.S. PATENT DOCUMENTS

| | | | | |
|---|---|---|---|---|
| 2,088,904 | A | 8/1937 | Grammer | |
| 4,724,460 | A | 2/1988 | Shinyashiki | |
| 4,891,681 | A | 1/1990 | Fiske et al. | |
| 5,398,289 | A | 3/1995 | Rourke et al. | |
| 5,508,798 | A | 4/1996 | Yamada | |
| 6,308,041 | B2 | 10/2001 | Shiramura | |
| 6,381,442 | B1 | 4/2002 | Okitsu et al. | |
| 7,137,625 | B2 * | 11/2006 | Yamada et al. | 270/58.07 |
| 7,281,707 | B2 | 10/2007 | Moriyama et al. | |
| 7,285,084 | B2 | 10/2007 | Fujimoto et al. | |
| 7,325,799 | B2 | 2/2008 | Watkiss | |
| 7,458,567 | B2 * | 12/2008 | Yamada et al. | 270/58.07 |

(Continued)

FOREIGN PATENT DOCUMENTS

| | | | |
|---|---|---|---|
| JP | 2004-066582 | A | 3/2004 |
| JP | 2004-210436 | A | 7/2004 |

(Continued)

OTHER PUBLICATIONS

Japanese Office Action corresponding to JP 2007-213843, dated Dec. 22, 2011. Cited in parent U.S. Appl. No. 12/194,321.

(Continued)

*Primary Examiner* — Patrick Mackey
(74) *Attorney, Agent, or Firm* — Rossi, Kimms & McDowell LLP

(57) ABSTRACT

A printing system which is capable of performing square back processing and preventing occurrence of a new trouble of inadvertently creating a saddle-stitched brochure defective in the appearance of a trimmed edge and/or print appearance, which is unexpected by an operator. A receiving unit receives a job of a first type for creating a saddle-stitched brochure subjected to square back processing and trimming processing or a second type creating a saddle-stitched brochure not subjected to the square back processing but subjected to the trimming processing. A controller controls a trimming position at an end of the sheet bundle for the job and/or an image printing position on a sheet included in the sheet bundle based on whether a job to be processed is of the first type or of the second type.

23 Claims, 25 Drawing Sheets

U.S. PATENT DOCUMENTS

| | | | |
|---|---|---|---|
| 7,594,645 | B2 | 9/2009 | Suzuki et al. |
| 7,607,650 | B2 | 10/2009 | Oikawa et al. |
| 7,660,556 | B2 | 2/2010 | Saitsu et al. |
| 7,891,928 | B2 | 2/2011 | Harada |
| 7,907,887 | B2 | 3/2011 | Asai et al. |
| 7,976,450 | B2 | 7/2011 | Endo |
| 8,109,495 | B2 | 2/2012 | Kikkawa et al. |
| 2005/0008460 | A1 | 1/2005 | Watkiss |
| 2006/0153612 | A1 | 7/2006 | Saitsu et al. |
| 2006/0263174 | A1 | 11/2006 | Oikawa et al. |
| 2007/0035081 | A1 | 2/2007 | Kaneko et al. |
| 2007/0045926 | A1 | 3/2007 | Fukatsu et al. |
| 2007/0120310 | A1 | 5/2007 | Awano |
| 2009/0290170 | A1 | 11/2009 | Matsumura |

FOREIGN PATENT DOCUMENTS

| | | | |
|---|---|---|---|
| JP | 2004-310746 | A | 11/2004 |
| JP | 2004-310747 | A | 11/2004 |
| JP | 2005-321757 | A | 11/2005 |
| JP | 2006-159894 | A | 6/2006 |
| JP | 2006-285709 | A | 10/2006 |
| JP | 2006-321622 | A | 11/2006 |
| JP | 2007-147815 | A | 6/2007 |

OTHER PUBLICATIONS

Japanese Office Action for corresponding JP 2007-213842, mail date Jan. 17, 2012. Cited in parent U.S. Appl. No. 12/194,321.

Japanese Office Action for corresponding JP 2007-213842, mail date Apr. 3, 2012. Cited in parent U.S. Appl. No. 12/194,321.

Specification and drawing of U.S. Appl. No. 12/194,242, filed Aug. 19, 2008. Masayuki Toda et al. "Printing system, printing apparatus, job processing method, storage medium, and program". pp. 1-145; 22 drawing sheets. Cited in parent U.S. Appl. No. 12/194,321.

* cited by examiner

*FIG. 25*

2400

| SADDLE-STITCH JOB TYPE | FIRST-TYPE RESTRICTION CONDITIONS (RULES ON TRIMMING AMOUNT) | SECOND-TYPE RESTRICTION CONDITIONS (RULES ON CREEP CORRECTION AMOUNT) |
|---|---|---|
| SADDLE-STITCH JOB WITHOUT SQUARE BACK PROCESSING | [RULE 1-1]<br>TRIMMING BY TRIMMING AMOUNT WITHIN RANGE OF NOT SMALLER THAN 10.0 mm AND NOT LARGER THAN 30.0 mm IS PERMITTED.<br>※TRIMMING BY TRIMMING AMOUNT OUTSIDE THE RANGE IS INHIBITED | [RULE 2-1]<br>SADDLE-STITCH PRINTING BASED ON CREEP CORRECTION AMOUNT WITHIN RANGE OF NOT SMALLER THAN 0.10 mm AND NOT LARGER THAN 10.00 mm IS PERMITTED.<br>※SADDLE-STITCH PRINTING BASED ON CREEP CORRECTION AMOUNT OUTSIDE THE RANGE IS INHIBITED. |
| SADDLE-STITCH JOB WITH SQUARE BACK PROCESSING | [RULE 1-2]<br>TRIMMING BY TRIMMING AMOUNT WITHIN RANGE OF NOT SMALLER THAN 20.0 mm AND NOT LARGER THAN 30.0 mm IS PERMITTED.<br>※TRIMMING BY TRIMMING AMOUNT OUTSIDE THE RANGE IS INHIBITED | [RULE 2-2]<br>SADDLE-STITCH PRINTING BASED ON CREEP CORRECTION AMOUNT WITHIN RANGE OF NOT SMALLER THAN 0.20 mm AND NOT LARGER THAN 10.00 mm IS PERMITTED. |

BOOKBINDING SYSTEM WITH CONTROLLED TRIMMING UNIT

This is a divisional of Ser. No. 12/194,321, filed Aug. 19, 2008, for which benefit is claimed, and status is pending, which in turn claims priority from JP Application No. 2007-213842, filed Aug. 20, 2007 the content of which is incorporated herein by reference.

BACKGROUND OF THE INVENTION

1. Field of the Invention

The present invention relates to a printing system which is configured to be capable of performing square back processing, a job processing method, a storage medium, a program product and a printing apparatus.

2. Description of the Related Art

Recently, there has been proposed a POD (Print On Demand) printing system using an electrophotographic printing apparatus or an inkjet printing apparatus (see Japanese Patent Laid-Open Publications No. 2004-310746 and No. 2004-310747). The POD printing system of this type is advantageous in that block copy preparation and other complicated operations required by an offset plate making printer can be dispensed with.

On the other hand, in the POD market, there can be demands for creating various forms of printouts. For example, there can be a demand for creating a printout subjected to saddle-stitching bookbinding (hereinafter also referred to "saddle-stitched brochure") having a special form obtained e.g. by performing a squaring process for making square the back of a saddle-stitched brochure (such that a square back is formed). To perform a squaring process such that the back of a saddle-stitched brochure is flattened (i.e. roundness of the back is suppressed) is referred to as square back (or square hold) processing. There has been proposed a technique for performing the square back processing by a special post-processing apparatus (see Japanese Patent Laid-Open Publication No. 2006-159894).

However, the above-mentioned post-processing apparatus capable of performing the square back processing is configured to be usable as an offline finisher provided independently of a printing apparatus. For this reason, an operator (or a user) is required to carry out work for taking out a printout after execution of printing by the printing apparatus, and manually setting the printout in the post-processing apparatus.

In view of this situation, it can be expected that the POD market or the like will demand a printing system in which a post-processing apparatus capable of creating a saddle-stitched brochure subjected to square back processing can be made use of as an inline finisher connectable to a printing apparatus, in the future. Further, it can be expected that there will be a demand for a printing system which is capable of carrying out an entire process from print processing executed by a printing apparatus to creation of a saddle-stitched brochure subjected to square back processing, in the future.

In a case where a printing system is configured to be capable of meeting the above-mentioned demands, it is preferable to prevent occurrence of a trouble due to the fact that the system is configured to be capable of performing the process from print processing to square back processing.

However, the present situation is not such that the above-mentioned possible problem of occurrence of the trouble is tackled to provide a countermeasure for making such a printing system commercially available/practical, and hence, no research has been made on a mechanism for preventing occurrence of troubles that can occur in the following situations:

Let it be assumed, for example, that the printing system has a trimmer unit capable of trimming a saddle-stitched brochure delivered from the printing apparatus, at a fore edge of the brochure, which is an opposite end from the back of the same. The trimmer unit trims the saddle-stitched brochure by a predetermined trimming amount specified by a distance from the fore edge of the brochure. Assume, on the other hand, a case where the trimmer unit of the printing system is capable of trimming both a saddle-stitched brochure in a job not requiring square back processing and a saddle-stitched brochure in a job requiring square back processing. In this case, when the trimmer unit trims the saddle-stitched brochure in the job requiring square back processing, an event can occur in which one or more outer sheets (which can include not only a cover sheet disposed on the outermost side of the printout (i.e. a sheet bundle formed by a plurality of sheets and folded in half by saddle-stitch processing), but also one or more outer sheets of the main portion of the printout) of the brochure are not trimmed, but only one or more inner sheets (i.e. the main portion) of the same are trimmed, which makes the creation of the brochure wasteful.

Further, assume a case where the printing system tentatively performs printing using ordinary sheets and saddle stitching of printed sheets to check the finished state of a saddle-stitched brochure, and then in actual printing, performs reprinting using thick sheets to thereby create the saddle-stitched brochure. Further, let be assumed that a saddle-stitch job originally configured to be one not requiring square back processing can be changed to one requiring the square back processing. When the printing system is thus configured, the above-mentioned event can occur in which the substance (one or more inner sheets) of the saddle-stitched brochure is trimmed, but one or more outer sheets including a cover sheet are not.

Furthermore, although there occurs no problem with printing positions in processing without square back processing, the saddle-stitched brochure trimmed as above after being subjected to processing with square back processing can suffer from the problem of a shift in image position being caused between inner sheets and outer sheets of the brochure.

As described above, when the printing system is constructed to be capable of performing square back processing, there is a possibility of a new trouble of inadvertently creating a saddle-stitched brochure defective in the appearance of a trimmed edge and/or print appearance, which is unexpected by an operator.

SUMMARY OF THE INVENTION

The present invention provides a printing system which is capable of performing square back processing and preventing occurrence of a new trouble of inadvertently creating a saddle-stitched brochure defective in the appearance of a trimmed edge and/or print appearance, which is unexpected by an operator, as well as a job processing method, a storage medium, a program product and a printing apparatus.

In a first aspect of the present invention, there is provided a printing system comprising a receiving unit adapted to receive a job of a first type or a second type, the job of the first type being a job for creating a saddle-stitched brochure subjected to square back processing and trimming processing and the job of the second type being a job for creating a saddle-stitched brochure not subjected to the square back processing but subjected to the trimming processing, the square back processing being performed by a working unit, the working unit being a unit adapted to form a flat surface on a back of a sheet bundle subjected to saddle-stitch processing, the saddle-stitch processing being performed by a saddle stitching unit, the saddle stitching unit being adapted to perform the saddle-stitch processing on a sheet bundle subjected to print processing by a printing unit, and a control unit adapted to control a trimming position and/or a printing position based on whether a job to be processed is of the first type or of the second type, the trimming position being a trimming position at an end of the sheet bundle for the job, and the printing position being an image printing position on a sheet included in the sheet bundle.

In a second aspect of the present invention, there is provided a job processing method applied to a printing system, comprising receiving a job of a first type or a second type, the job of the first type being a job for creating a saddle-stitched brochure subjected to square back processing and trimming processing and the job of the second type being a job for creating a saddle-stitched brochure not subjected to the square back processing but subjected to the trimming processing, the square back processing being performed by a working unit, the working unit being a unit adapted to form a flat surface on a back of a sheet bundle subjected to saddle-stitch processing, the saddle-stitch processing being performed by a saddle stitching unit, the saddle stitching unit being adapted to perform the saddle-stitch processing on a sheet bundle subjected to print processing by a printing unit, and controlling a trimming position and/or a printing position based on whether a job to be processed is of the first type or of the second type, the trimming position being a trimming position at an end of the sheet bundle for the job, and the printing position being an image printing position on a sheet included in the sheet bundle.

In a third aspect of the present invention, there is provided a computer-readable storage medium storing a program for causing a computer to execute the job processing method.

In a fourth aspect of the present invention, there is provided a program product for causing a computer to execute the job processing method, the program being storable in a computer-readable storage medium.

In a fifth aspect of the present invention, there is provided a printing apparatus applicable to the printing system, comprising the printing unit, the receiving unit, and the control unit.

With the configuration of the present invention, it is possible to prevent the printing system capable of performing square back processing from causing a new trouble of inadvertently creating a saddle-stitched brochure defective in the appearance of a trimmed edge and/or print appearance, which is unexpected by an operator.

The features and advantages of the invention will become more apparent from the following detailed description taken in conjunction with the accompanying drawings.

BRIEF DESCRIPTION OF THE DRAWINGS

FIG. 25 is a diagram showing an example of a management table.

DETAILED DESCRIPTION OF THE EMBODIMENTS

The present invention will now be described in detail with reference to the drawings showing embodiments thereof.

Figure 1:
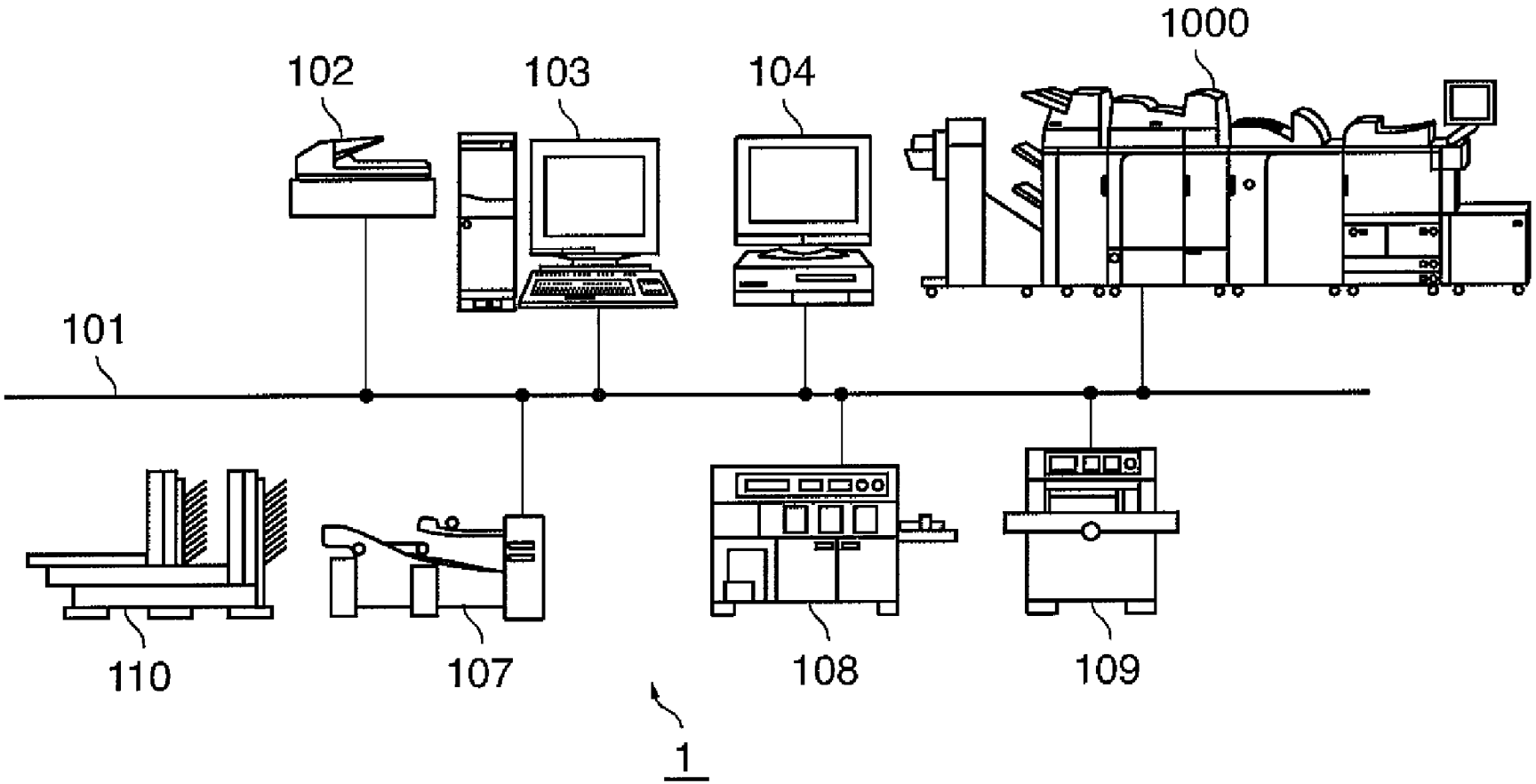
FIG. 1 is a view of a POD system suitable for a printing system according to an embodiment of the present invention.

FIG. 1 is a view of a POD system suitable for a printing system according to an embodiment of the present invention.

The POD system 1 includes the printing system 1000, a scanner 102, a server computer (PC) 103, and a client computer (PC) 104, which are interconnected via a network 101. Further, the POD system 1 includes a sheet folding machine 107, a trimming machine 109, a saddle stitching machine 110, and a casing-in machine 108.

The PC 103 manages data transmission and reception to and from various apparatuses connected to the network 101. The PC 104 transmits image data to the printing system 1000 or the PC 103 via the network 101. The sheet folding machine 107 performs folding of sheets printed by the printing system 1000. The casing-in machine 108 performs case binding of sheets printed by the printing system 1000. The trimming machine 109 performs trimming of each sheet bundle formed of sheets printed by the printing system 1000. The saddle stitching machine 110 performs saddle-stitch processing on each sheet bundle formed by sheets printed by the printing system 1000.

In the case of using the sheet folding machine 107, the casing-in machine 108, the trimming machine 109, or the saddle stitching machine 110, an operator (or a user) takes out a bundle of printed sheets from the printing system 1000 and sets the same in the machine so as to cause the machine to perform the associated processing.

The machines and apparatuses included in the POD system 1 are connected to the network 101 except the saddle stitching machine 110 such that they can perform data communication with each other.

Next, the configuration of the printing system 1000 will be described with reference to FIGS. 2 and 3.

Figure 2:
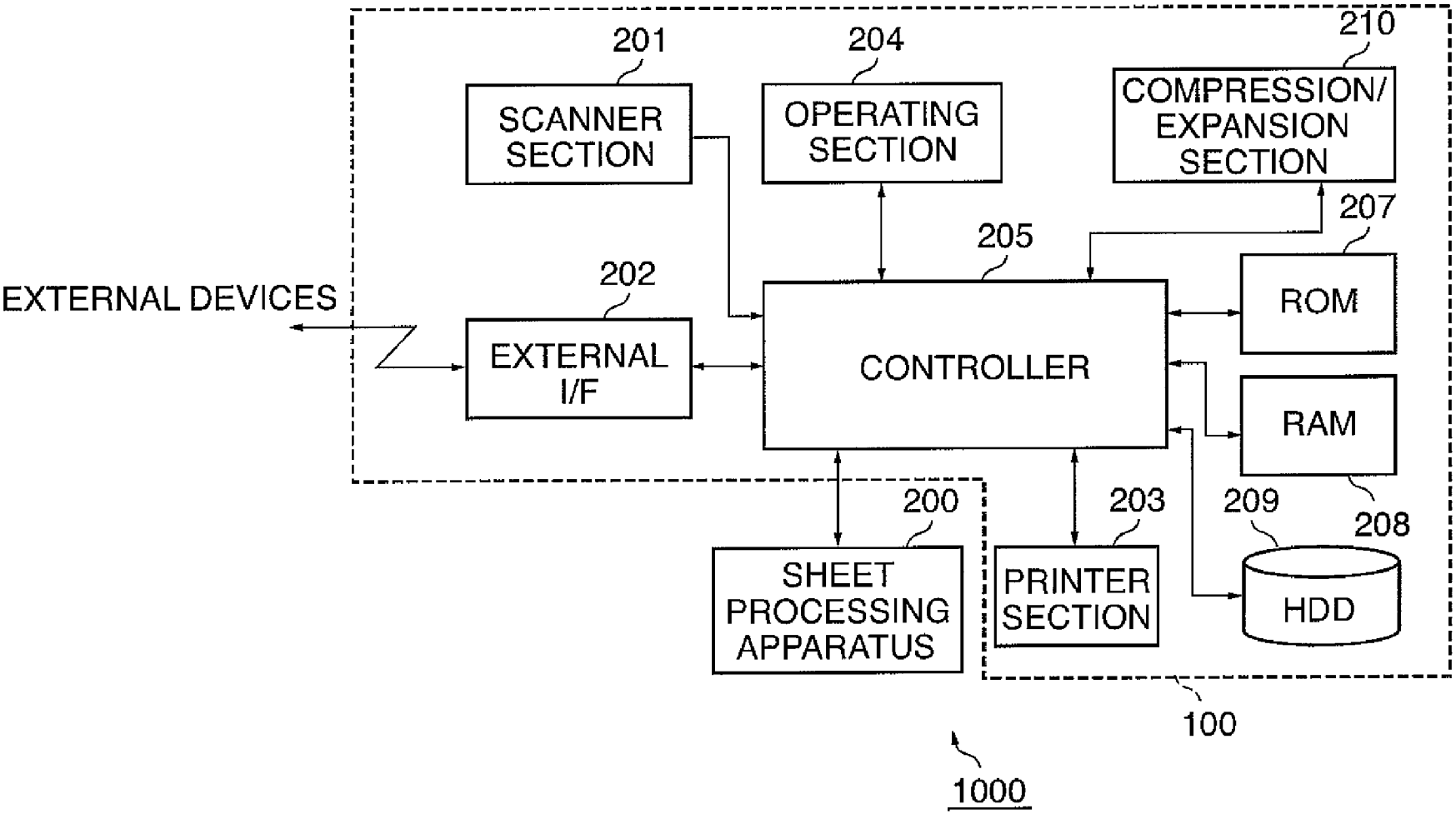
FIG. 2 is a block diagram of the printing system.

FIG. 2 is a block diagram of the printing system 1000.

As shown in FIG. 2, the printing system 1000 is comprised of a printing apparatus 100 and sheet processing apparatuses (post-processing apparatuses) 200 connected to the printing apparatus 100. In the present embodiment, the printing apparatus 100 is implemented by an MFP (Multi-Function Peripheral) equipped with a plurality of functions including a copying function and a printing function. It should be noted that the printing apparatus 100 may be a single-function printing apparatus having only the copying function or the printing function.

Units included in the printing system 1000 belong to the printing apparatus 100 except the sheet processing apparatuses 200. The printing apparatus 100 can have an optional number of sheet processing apparatuses 200 connected thereto. The printing system 1000 is configured to be capable of causing the sheet processing apparatuses 200 connected to the printing apparatus 100 to execute sheet processing (post processing) on sheets printed by the printing apparatus 100. It should be noted that it is possible to form the printing system 1000 by the printing apparatus 100 alone without connecting the sheet processing apparatuses 200 to the printing apparatus 100.

Each of the sheet processing apparatuses 200 is communicable with the printing apparatus 100, and is capable of performing post processing, described hereinafter, in response to an instruction from the printing apparatus 100. A scanner section 201 reads an image from an original and converts the image into image data, followed by transferring the image data to another unit. An external I/F 202 exchanges data with other apparatuses (external devices) connected to the network 101. A printer section 203 prints an image on a sheet based on input image data. An operating section 204 has a hard key input section (key input section) 402 and a touch panel section 401, described hereinafter, and accepts instructions from the operator via the hard key input section 402 or the touch panel section 401. Further, the operating section 204 performs various kinds of display on the touch panel section 401.

A controller 205 performs centralized overall control of the processing and operations of the respective units included in the printing system 1000. More specifically, the controller 205 controls not only the operation of the printing apparatus 100, but also that of each of the sheet processing apparatuses 200 connected to the printing apparatus 100. A ROM 207 stores various computer programs to be executed by the controller 205. For example, the ROM 207 stores programs for causing the controller 205 to execute processes of respective flowcharts, described hereinafter, and a display control program required for displaying various kinds of configuration screens, described hereinafter. Further, the ROM 207 stores a program for causing the controller 205 to perform an operation for interpreting PDL (Page Description Language) code data received from the PC 103, the PC 104, or the like, and converting the data into raster image data. Furthermore, the ROM 207 stores a boot sequence, font information, etc.

A RAM 208 stores image data sent from the scanner section 201 or the external I/F 202, various kinds of programs loaded from the ROM 207, and configuration information.

Further, the RAM 208 stores information concerning the sheet processing apparatuses 200. The information concerning the sheet processing apparatuses 200 includes the number (0 to n) of the apparatuses connected to the printing apparatus 100, information concerning the functions of each of the sheet processing apparatuses 200, the connection order of the sheet processing apparatuses 200, and so forth.

A HDD (hard disk drive) 209 includes a hard disk and a drive section that reads/writes data from/into the hard disk. The HDD 209 is a large-capacity storage device for storing image data input from the scanner section 201 or the external I/F 202 and compressed by a compression/expansion section 210. The controller 205 is capable of causing the printer section 203 to print image data stored in the HDD 209, based on an instruction from the operator. Further, the controller 205 is capable of sending image data stored in the HDD 209 to an external device, such as the PC 103, via the external I/F 202 based on an instruction from the operator. The compression/expansion section 210 compresses/expands image data and the like stored in the RAM 208 or the HDD 209 using one of various kinds of compression methods including JBIG and JPEG.

Figure 3:
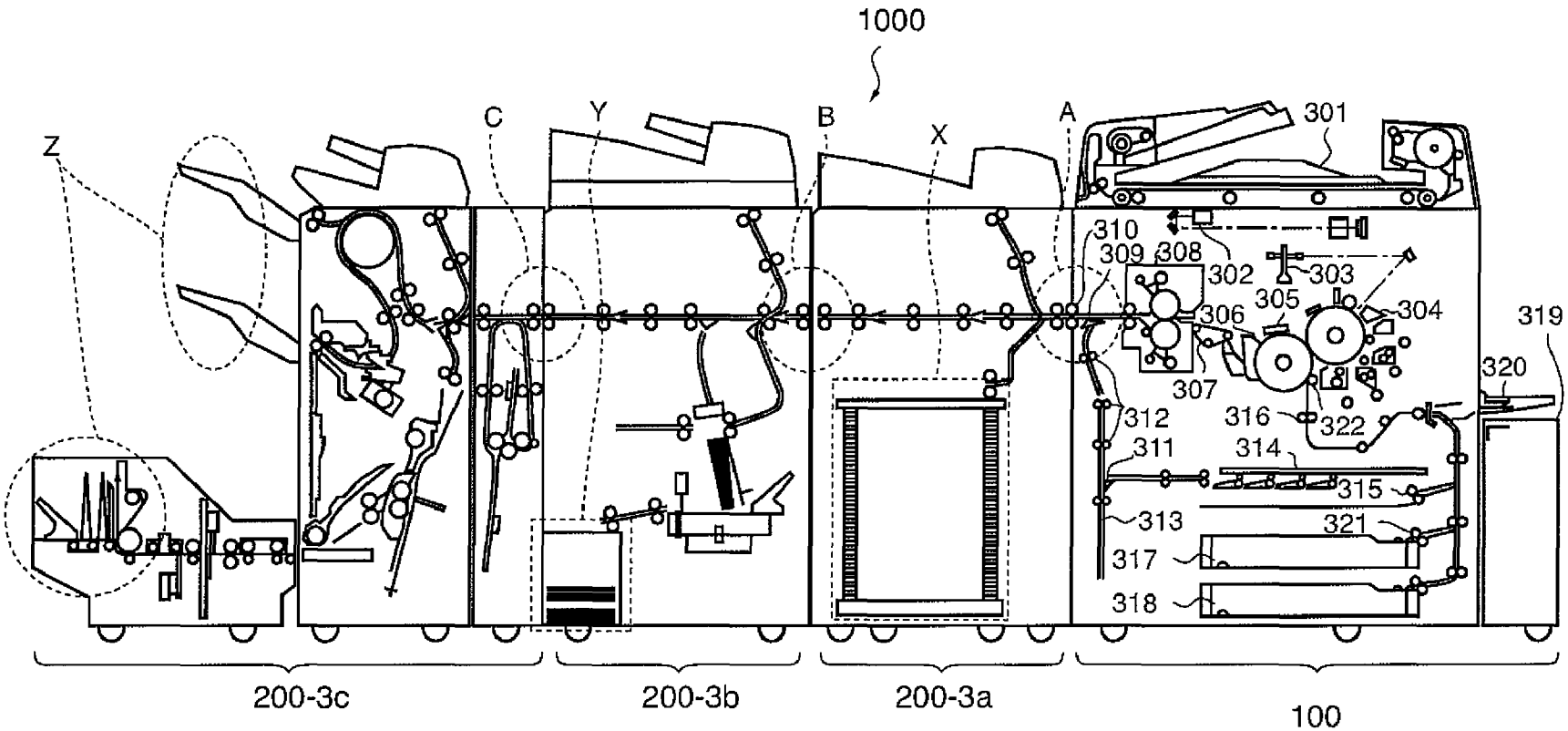
FIG. 3 is a schematic longitudinal cross-sectional view of a printing apparatus and a plurality of sheet processing apparatuses constituting the printing system.

FIG. 3 is a schematic longitudinal cross-sectional view of the printing apparatus 100 and the sheet processing apparatuses 200 constituting the printing system 1000.

Referring to FIG. 3, the sheet processing apparatuses 200 in the printing system 1000 can be optionally selected from various kinds of sheet processing apparatuses to connect a desired number of them to one another insofar as sheets can be sequentially conveyed from an upstream apparatus to a downstream one through a sheet conveying path. For example, as shown in FIG. 3, a large-capacity stacker 200-3*a*, a glue binding machine 200-3*b*, and a saddle stitching machine 200-3*c* can be sequentially connected to one another in the mentioned order as viewed from the printing apparatus 100, and can be selectively used in the printing system 1000. Further, each of the sheet processing apparatuses 200 has a sheet discharging section, so that the operator can take out sheets having undergone sheet processing from the sheet discharging section.

An automatic document feeder (ADF) 301 sequentially separates sheets of an original bundle set on the sheet stacking surface of a document tray, one by one in order from a first page, and conveys the separated sheets one by one onto an original platen glass for scanning by the scanner section 302.

The scanner section 302 reads an image from an original conveyed onto the original platen glass and converts the image into image data by a CCD (Charge Coupled Device). A rotary polygon mirror 303 receives light, such as a laser beam, modulated according to the image data, and emits the light onto a photosensitive drum 304 via a reflective mirror as reflected scanning light. A latent image formed on the photosensitive drum 304 by the laser beam is developed by toner, and the developed toner image is transferred onto a sheet wound around a transfer drum 305. This sequential image forming process is carried out sequentially using yellow (Y) toner, magenta (M) toner, cyan (C) toner, and black (K) toner in the mentioned order, whereby a full-color image is formed.

After execution of the four image forming processes, the sheet having the full-color image formed thereon is separated from the transfer drum 305 by a separation claw 306, and is conveyed to a fixing device 308 by a pre-fixing conveyor 307. The fixing device 308 incorporates rollers, a belt, and a heater, such as a halogen heater, and dissolves toner of the toner image transferred on the sheet having, by heat and pressure, to thereby fix the toner image on the sheet. A discharge flapper 309 is configured to be swingable about a swing shaft to regulate a sheet conveying direction. When the discharge flapper 309 has swung in a clockwise direction as viewed in FIG. 3, a sheet is conveyed straight to be discharged out of the apparatus by a discharge roller 310. The controller 205 causes the printing apparatus 100 to execute the above-mentioned series of sequences to thereby perform single-sided printing.

On the other hand, in the case of forming images on the respective opposite sides of a sheet, the discharge flapper 309 swings in a counterclockwise direction as viewed in FIG. 3, to change a sheet conveying direction downward, whereby a sheet is conveyed into a double-sided conveyor. The double-sided conveyor is comprised of an inverting flapper 311, inverting rollers 312, an inverting guide 313, and a double-sided tray 314. The inverting flapper 311 swings about a swing shaft to regulate a sheet conveying direction.

In the case of processing a double-sided printing job, the controller 205 swings the inverting flapper 311 in the counterclockwise direction as viewed in FIG. 3 to thereby convey a sheet having an image formed on a first side thereof in the printer section 203 to the inverting guide 313 via the inverting rollers 312. Then, the controller 205 temporarily stops the inverting rollers 312 in a state nipping the trailing end of the sheet, followed by swinging the inverting flapper 311 in the clockwise direction as viewed in FIG. 3. Then, the controller 205 causes the inverting roller 312 to perform reverse rotation. Thus, the controller 205 causes the sheet to be conveyed in a switched-back manner, whereby the sheet is guided onto the double-sided tray 314 with its leading and trailing ends reversed.

The sheet guided to the double-sided tray 314 is temporarily placed thereon, and then conveyed to a registration roller 316 again by reefed rollers 315. At this time, the sheet is conveyed with a reverse side thereof opposite to the first side in a facing relation to the photosensitive drum. Then, a second-side image is formed on the second side (reverse side) of the sheet by processes similar to those associated with the first side. Thus, the sheet having the images formed on the both sides thereof passes through the fixing device 308, followed by being discharged out from the printing apparatus 100 via the discharge roller 310. The controller 205 causes the printing apparatus 100 to execute the above-mentioned series of sequences to thereby to perform double-sided printing.

The printing apparatus 100 has feeder sections each containing sheets necessary for printing. The feeder sections include sheet feed cassettes 317 and 318 (each of which is capable of containing 500 sheets, for example), a sheet feed deck 319 (which is capable of containing 5000 sheets, for example), and a manual feed tray 320. The sheet feed cassettes 317 and 318 and the sheet feed deck 319 are configured such that sheets of kinds different in size and material can be separately set in the respective feeder sections. It is possible to set various kinds of sheets including special sheets, such as OHP sheets, on the manual feed tray 320. Each of the sheet feed cassettes 317 and 318, the sheet feed deck 319, and the manual feed tray 320 is provided with a feed roller, and sheets therein are continuously fed one by one by the feed roller.

Next, a description will be given of the sheet processing apparatuses 200 appearing in FIG. 3.

The controller 205 accepts, as a job, a request for execution of sheet processing of a kind selected by the operator from candidates of various kinds of sheet processing executable by the sheet processing apparatuses 200 connected to the printing apparatus 100, via the operating section 204 together with a printing execution request. Then, in response to the printing execution request of the job accepted from the operator via the operating section 204, the controller 205 causes the printer section 203 to execute print processing required for the job. Further, the controller 205 causes sheets having undergone the print processing to be conveyed through the sheet conveying path to a sheet processing apparatus which is capable of executing the sheet processing desired by the operator, and causes the sheet processing apparatus to execute the sheet processing.

Let it be assumed that the printing system 1000 having a system configuration shown in FIG. 3 accepts from the operator a job which is associated with a printing execution request and instructs execution of large-quantity stacking processing by the large-capacity stacker 200-3*a*. This job will be referred to as "the stacker job". In the case of processing the stacker job in the printing system 1000 shown in FIG. 3, the controller 205 causes the printing system 1000 to convey sheets printed by the printing apparatus 100 into the large-capacity stacker 200-3*a* while passing the sheets over a point A appearing in FIG. 3. Thereafter, the controller 205 causes the large-capacity stacker 200-3*a* to execute stacking processing of the stacker job. Then, the controller 205 holds a printout (one set of printed sheets) subjected to the stacking processing by the large-capacity stacker 200-3*a* in a discharge destination X within the large-capacity stacker 200-3*a*, without conveying the printout to another apparatus (e.g. an apparatus disposed downstream of the large-capacity stacker 200-3*a*).

The printout held in the discharge destination X for the stacker job can be taken out directly from the discharge destination X by the operator. This eliminates the necessity of a series of apparatus operations and an operator operation for conveying sheets to a discharge destination Z most downstream in the sheet conveying direction in FIG. 3 and then taking out the printout for the stacker job.

Let it be assumed that in the print system 1000, a job associated with a printing execution request accepted from the operator instructs execution of sheet processing (e.g. glue binding selected between case binding and top gluing) by the glue binding machine 200-3*b*. This job will be referred to as "the glue binding job". In the case of processing the glue binding job in the printing system 1000, the controller 205 causes the printing system 1000 to convey sheets printed by the printing apparatus 100 into the glue binding machine 200-3*b* while passing the sheets over the point A and a point B appearing in FIG. 3. Thereafter, the controller 205 causes the glue binding machine 200-3*b* to execute glue binding of the glue binding job. Then, the controller 205 holds the printout subjected to the glue binding by the glue binding machine 200-3*b* in a discharge destination Y within the glue binding machine 200-3*b*, without conveying the printout to another apparatus (e.g. an apparatus disposed downstream of the printing apparatus).

Let it be assumed that in the printing system 1000, a job associated with a printing execution request accepted from the operator instructs execution of sheet processing by the saddle stitching machine 200-3*c*. Examples of sheet processing executed by the saddle stitching machine 200-3*c* include saddle-stitch processing, punching, trimming, shift discharging, and folding. In the present embodiment, the job instructing execution of sheet processing by the saddle stitching machine 200-3*c* will be referred to as "the saddle-stitch job".

In the case of processing the saddle-stitch job in the printing system 1000, the controller 205 causes the printing system 1000 to convey sheets printed by the printing apparatus 100 into the saddle stitching machine 200-3*c* while passing the sheets over the points A and B and a point C. Thereafter, the controller 205 causes the saddle stitching machine 200-3*c* to execute the sheet processing of the saddle-stitch job. Then, the controller 205 holds the printout subjected to the sheet processing by the saddle stitching machine 200-3*c* in the discharge destination Z within the saddle stitching machine 200-3*c*.

It should be noted that the discharge destination Z is selected from a plurality of candidate discharge destinations. This is because the saddle stitching machine 200-3*c* is capable of executing a plurality of kinds of sheet processing, and different discharge destinations are used for the respective kinds of processing.

Next, the internal construction of the saddle stitching machine 200-3*c* will be described as an example of the sheet processing apparatus 200 connectable to the printing apparatus 100 with reference to FIG. 4.

Figure 4:
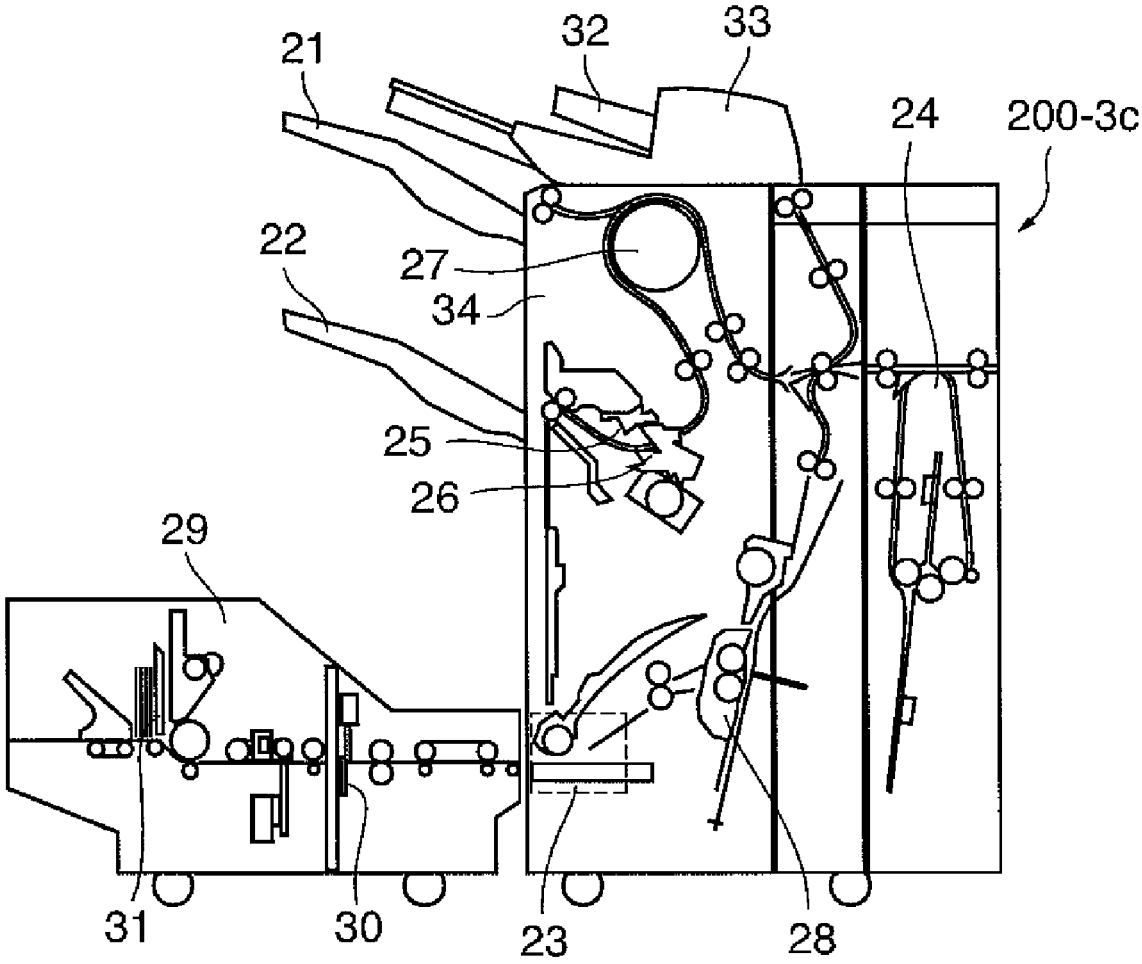
FIG. 4 is a schematic longitudinal cross-sectional view of a saddle stitching machine.

FIG. 4 is a schematic longitudinal cross-sectional view of the saddle stitching machine 200-3*c*.

The saddle stitching machine 200-3*c* is comprised of units enabling selective execution of stapling, trimming, punching, folding, shift discharging, and saddle-stitch processing, on sheets from the printing apparatus 100. Further, the saddle stitching machine 200-3*c* is capable of performing square back processing, described hereinafter. It should be noted that the saddle stitching machine 200-3*c* does not have a straight path for conveying sheets to a downstream apparatus. For this reason, in a case where a plurality of sheet processing apparatuses are connected to the printing apparatus 100, the saddle stitching machine 200-3*c* is disposed at the most downstream position.

A finisher 34 has a sample tray 21 and a stack tray 22 attached to the outside thereof, and has a square back-forming section 23 provided therein. A Z-folding machine 24 is connected to the upstream side of the finisher 34. In the case of executing a job instructing execution of Z folding, the controller 205 causes the Z-folding machine 24 to fold sheets printed by the printing apparatus 100 into a Z shape. Then, the controller 205 performs control such that the folded sheets pass through the saddle stitching machine to be discharged onto a discharge tray, i.e. the stack tray 22 or the sample tray 21.

When instructed to perform stapling by the saddle stitching machine 200-3*c*, the controller 205 performs control such that sheets printed by the printing apparatus 100 are sequentially stacked on a processing tray 25 disposed in the saddle stitching machine 200-3*c*. Then, when a number of sheets corresponding to one bundle are stacked on the processing tray 25, the controller 205 causes a stapler 26 to perform stapling. Thereafter, the controller 205 performs control such that the stapled sheet bundle is discharged from the processing tray 25 onto the stack tray 22.

Further, when instructed to perform punching by the saddle stitching machine 200-3*c*, the controller 205 causes a puncher 27 to punch sheets printed by the printing apparatus 100. Then, the controller 205 performs control such that the punched sheets are conveyed through the saddle stitching machine 200-3*c* to be discharged onto a discharge tray, i.e. the stack tray 22 or the sample tray 21.

Furthermore, in the case of executing a job instructing execution of saddle-stitch processing by the saddle stitching machine 200-3*c*, the controller 205 causes a saddle stitcher 28 to stitch a central portion (folding position for half folding to be performed later) of a sheet bundle formed by a number of sheets corresponding to one set, at two locations on the central portion. Then, the controller 205 causes a roller to come into contact with the central portion of the sheet bundle to fold the sheet bundle in half about the central portion. Thus, the sheet bundle can be bound into a booklet form. In the present embodiment, the sequence of sheet processing executed by the saddle stitcher 28 and including the two steps of stitching a sheet bundle at two locations and folding the sheet bundle in half will be referred to as the saddle-stitch processing. The sheet bundle subjected to the saddle-stitch processing by the saddle stitcher 28 is conveyed to the square back-forming section 23.

A description will be given of a case where a job is processed which instructs execution of saddle-stitch processing on a sheet bundle and further square back processing on the back of the saddle-stitched sheet bundle. The controller 205 controls the printing system 1000 such that after the saddle stitcher 28 executes the saddle-stitch processing on the printout printed by the printing apparatus 100, processing for making square the back of the saddle-stitched sheet bundle is performed in the square back-forming section 23. After completion of the processing, the printout is conveyed to a discharge port.

When a job instructing execution of saddle-stitch processing includes an instruction for performing trimming, the controller 205 performs control such that a saddle-stitched sheet bundle is conveyed from the discharge port to a trimmer 29. Thereafter, the controller 205 causes a cutter 30 to trim the sheet bundle conveyed to the trimmer 29, and then causes a booklet holding section 31 to hold the sheet bundle. The saddle stitching machine 200-3*c* shown in FIG. 4 is also configured to be capable of performing three-way trimming (processing for trimming three edges of a sheet bundle except for the back of the same) on a saddle-stitched sheet bundle. It should be noted that when the saddle stitching machine 200-3*c* does not have the trimmer 29, it is possible to take out a sheet bundle bound by the saddle stitcher 28 from the discharge port.

The saddle stitching machine 200-3*c* is also configured to be capable of attaching a sheet (e.g. a cover sheet printed in advance) set in an insert tray 32 on an inserter 33 to sheets conveyed from the printing apparatus 100.

Next, square back processing executed by the square back-forming section 23 will be described with reference to FIGS. 5A to 5C. The square back-forming section 23 functions as a processing unit for crushing the back of a printout which is saddle-stitched by the aforementioned saddle stitcher 28, to thereby flatten the back (i.e. to form a flat surface). In the present embodiment, by using this function, the printing system 1000 can create a saddle-stitched brochure having its back flattened.

Figure 5A:
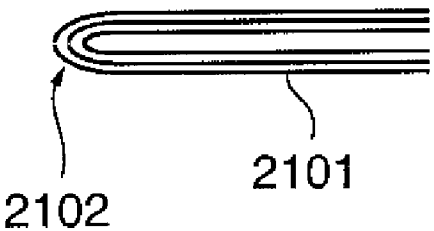
FIG. 5A is a schematic view of a sheet bundle having just undergone saddle stitching, which is useful in explaining the outline of square back processing.
Figure 5B:
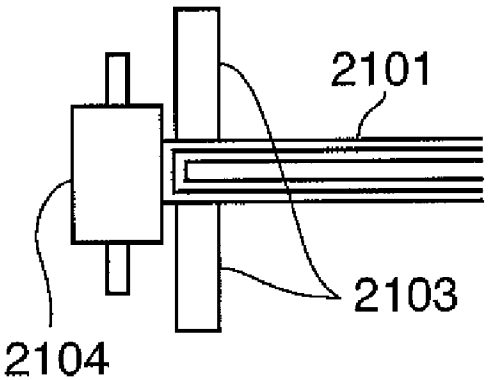
FIG. 5B is a schematic view of the sheet bundle being subjected to the square back processing by a square back-forming section, which is useful in explaining the outline of the square back processing.
Figure 5C:
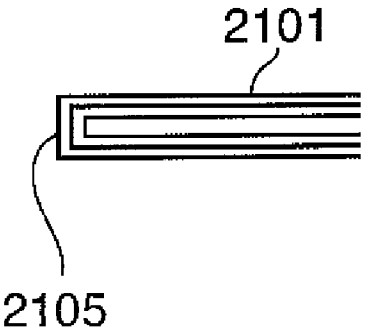
FIG. 5C is a schematic view of the sheet bundle having undergone the square back processing, which is useful in explaining the outline of the square back processing.

FIGS. 5A to 5C are schematic views useful in explaining the outline of the square back processing, in which FIG. 5A shows a sheet bundle which has just been saddle-stitched, FIG. 5B the sheet bundle which is being subjected to the square back processing by the square back-forming section, and FIG. 5C the sheet bundle which has already undergone the square back processing.

A booklet 2101 shown in FIG. 5A corresponds to a sheet bundle as one set of sheets printed by the printing apparatus 100. The sheets forming the booklet 2101 are sequentially printed one by one by the printing apparatus 100, and are supplied to the saddle stitcher 28 of the saddle stitching machine 200-3*c*. Then, when all the sheets as one set required to form the sheet bundle are received by the saddle stitcher 28, the saddle-stitch processing described above is performed on the sheet bundle. Thereafter, the saddle-stitched sheet bundle (i.e. the booklet 2101) is conveyed directly from the saddle stitcher 28 to the square back-forming section 23.

A folded part 2102 appearing in FIG. 5A corresponds to the back (i.e. the part stitched by the saddle stitcher at two locations and folded in half) of the booklet 2101.

As shown in FIG. 5B, the square back-forming section 23 has booklet-flattening members 2103 and 2104. These members are movable, and are configured to move from a predetermined standby position to abut on the booklet 2101 so as to perform the square back processing on the booklet 2101. Further, the members are configured to move back to the standby position upon completion of the square back processing so as to avoid interfering with conveyance of the booklet 2101.

The sheet bundle (booklet 2101) subjected to the saddle-stitch processing by the saddle stitcher 28 as described above is conveyed to the square back-forming section 23 with the folded part 2102 in the leading position as shown in FIG. 5A. Then, the booklet 2101 is nipped from the opposite sides by the booklet-flattening member 2103 as shown in FIG. 5B. Further, the folded part 2102 of the booklet 2101 is crushed by the booklet-flattening member 2104 to be flattened. The booklet 2101 thus undergoes the processing by the booklet-flattening members 2103 and 2104, whereby a flat surface 2105 is formed on the end of the folded part 2102 as shown in FIG. 5C.

In the present embodiment, the sequential sheet processing for flattening the back of a sheet bundle (i.e. forming a flat surface on the back) using the booklet-flattening members 2103 and 2104 so as to suppress bulging of the sheet bundle saddle-stitched by the saddle stitcher 28 is referred to as square back processing. The square back processing is also called a squaring process or square hold processing.

The booklet 2101 having undergone the square back processing is output to the booklet holding section 31 via the cutter 30 at a downstream location in the sheet conveying direction within the saddle stitching machine 200-3*c*.

The saddle-stitch job requiring saddle-stitch processing is roughly classified into one which requires square back processing, as described above, and another which does not. Whichever saddle-stitch job is selected, it is possible to output an associated printout to the booklet holding section 31 via the same conveying path.

For example, even a printout for the saddle-stitch job which does not require square back processing is also output to the booklet holding section 31 via the square back-forming section 23. In this case, the controller 205 locks the operations of the respective booklet-flattening members 2103 and 2104 so as to inhibit execution of square back processing by the square back-forming section 23. Then, in a state where the members are kept on standby, the printout for the saddle-stitch job is passed without being subjected to square back processing.

Next, the arrangement of the operating section 204 will be described with reference to FIG. 6.

Figure 6:
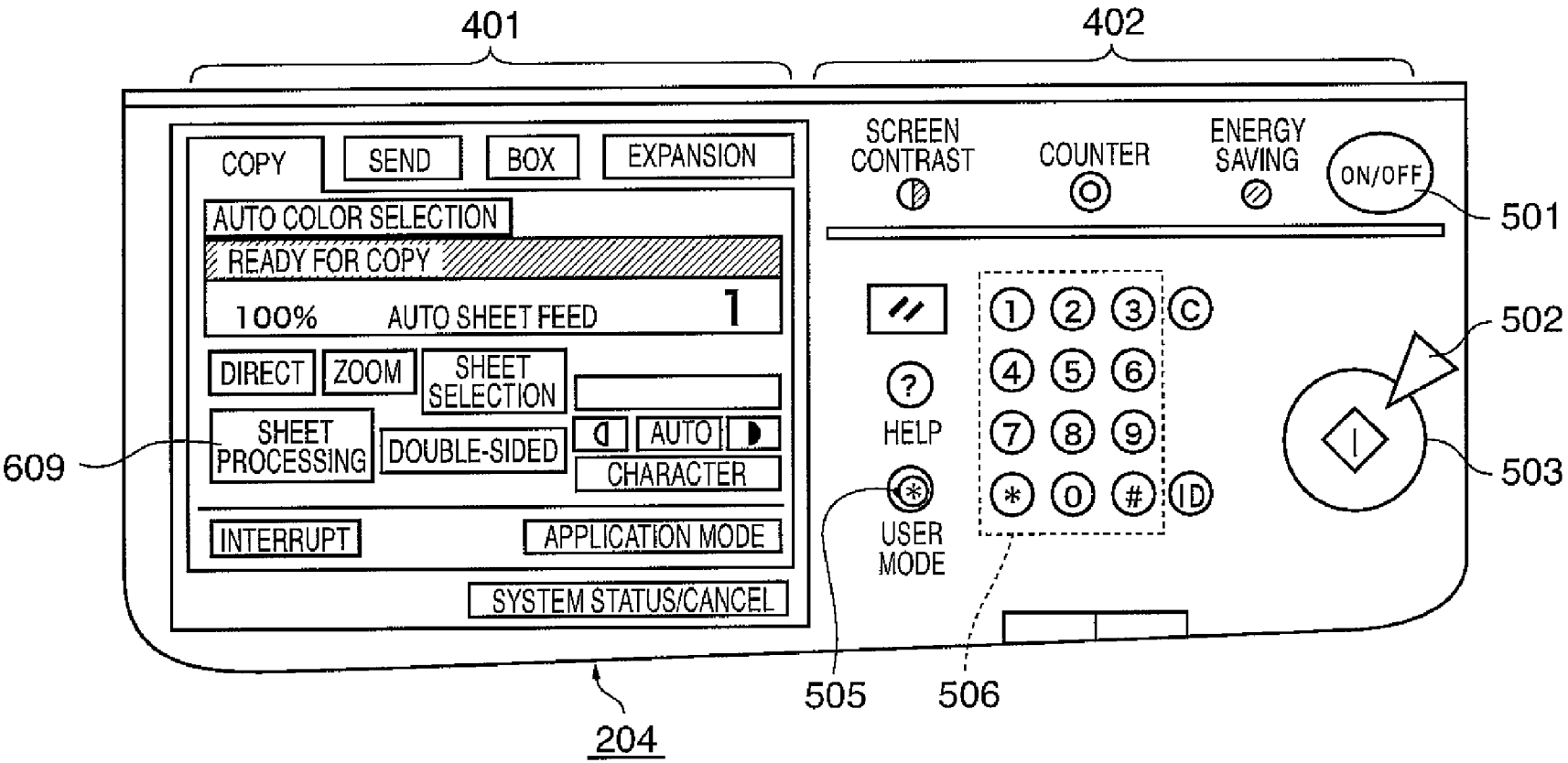
FIG. 6 is a view of the appearance of an operating section.

FIG. 6 is a view of the appearance of the operating section 204.

The operating section 204 is comprised of a touch panel section 401 and a key input section 402. The touch panel section 401 is comprised of an LCD (Liquid Crystal Display) and transparent electrodes laminated on the same, and displays various kinds of configuration screens for accepting instructions from the operator. The touch panel section 401 has not only a function of displaying the various screens, but also an instruction input function of accepting the instructions from the operator. The key input section 402 includes a power key 501, a start key 503, a stop key 502, a user mode key 505, and ten keys 506. The start key 503 is used to cause the printing apparatus 100 to start a copy job or a transmission job. The ten keys 506 are used to enter numerical values indicative of a copy count and the like.

The controller 205 controls the printing system 1000 such that the printing system 1000 performs various kinds of processing responsive to instructions accepted via the respective screens displayed on the touch panel section 401 or via the key input section 402.

Figure 7:
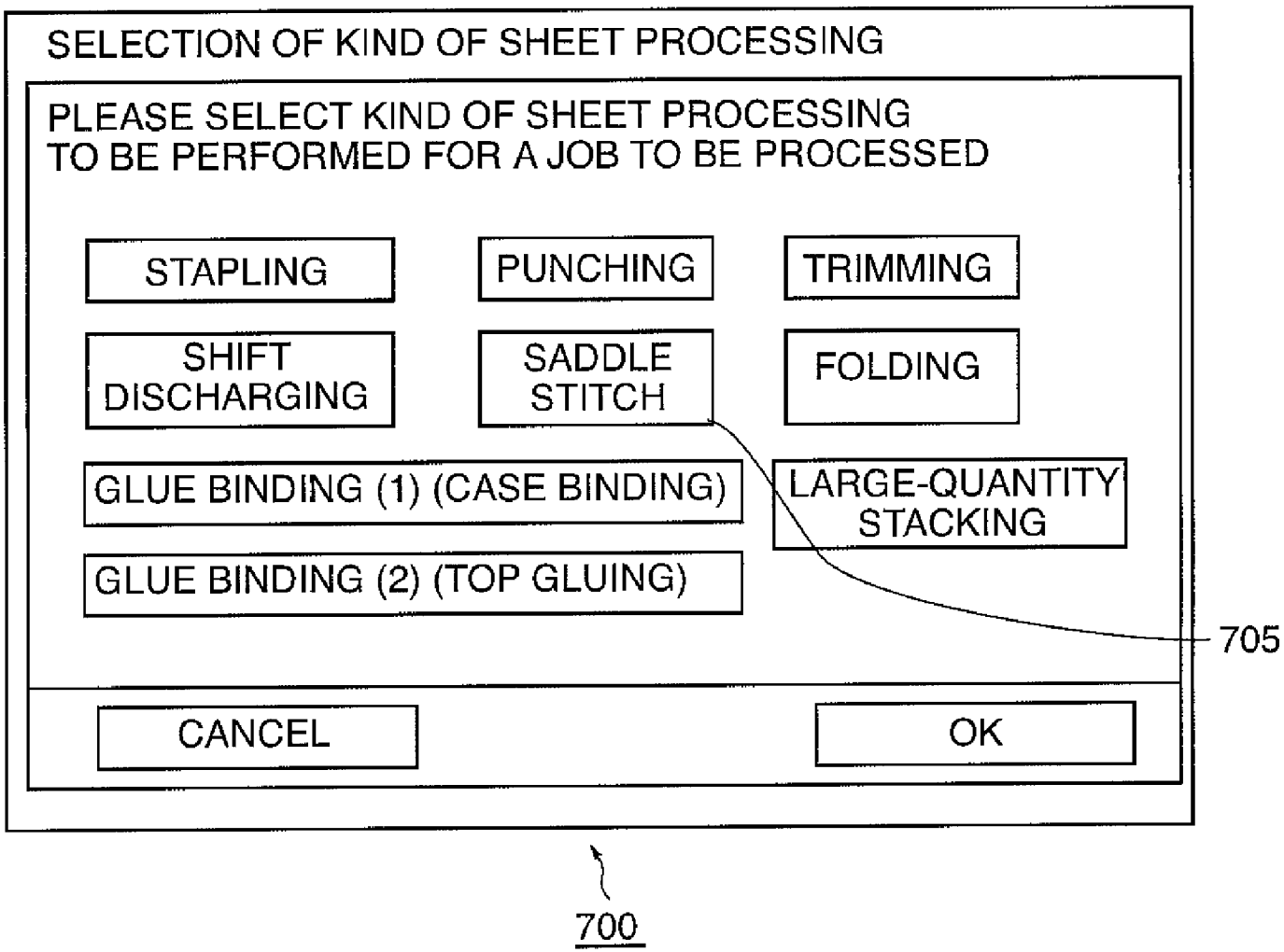
FIG. 7 is a view showing an example of a configuration screen prompting an operator to select a kind of sheet processing to be performed on sheets printed by the printing apparatus.

FIG. 7 is a view showing an example of a configuration screen prompting the operator to select the kind of sheet processing to be performed on sheets printed by the printing apparatus 100.

When the operator presses a sheet processing configuration key 609, appearing in FIG. 6, on the screen displayed on the touch panel section 401, the controller 205 displays the configuration screen 700 shown in FIG. 7 on the touch panel section 401. The configuration screen 700 enables the operator to select a desired one from various kinds of sheet processing executable by the sheet processing apparatuses 200 included in the printing system 1000. The controller 205 accepts settings of sheet processing to be executed in a job to be processed, from the operator, and causes the sheet processing apparatuses 200 to execute the sheet processing based on the settings.

Next, a case of processing an 8-page saddle-stitch job will be described as an example of saddle-stitch processing and print processing prior to the saddle-stitch processing.

Figure 8A:
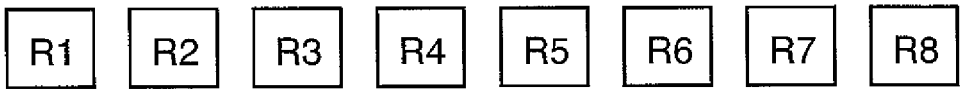
FIG. 8A is a view of image data for 8 pages, which is useful in explaining a flow of saddle-stitch processing and print processing prior to the saddle-stitch processing.
Figure 8B:
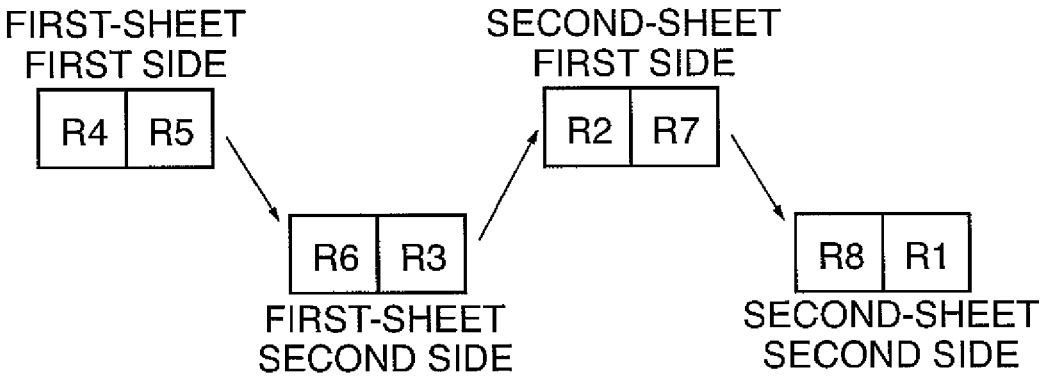
FIG. 8B is a view illustrating correspondence between the image data for 8 pages and image forming positions on sheets, which is useful in explaining the flow of the saddle-stitch processing and the print processing prior to the saddle-stitch processing.
Figure 8C:
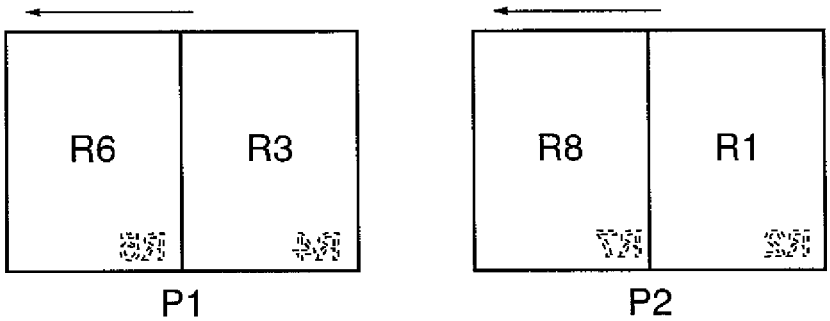
FIG. 8C is a view illustrating a sheet conveying direction of the sheets having associated images formed thereon, which is useful in explaining the flow of the saddle-stitch processing and the print processing prior to the saddle-stitch processing.
Figure 8D:
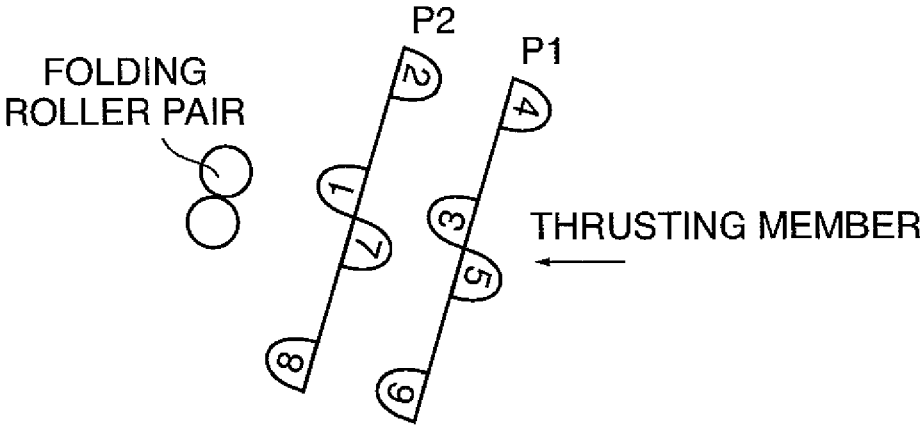
FIG. 8D is a view illustrating a saddle-stitch processing operation for saddle-stitch processing of a bundle of the sheets, which is useful in explaining the flow of the saddle-stitch processing and the print processing prior to the saddle-stitch processing.

FIGS. 8A to 8D are views useful in explaining a flow of the saddle-stitch processing and the print processing prior to the saddle-stitch processing, in which FIG. 8A illustrates image data for 8 pages, FIG. 8B illustrates correspondence between the image data for 8 pages and image forming positions on sheets, FIG. 8C illustrates a sheet conveying direction of the sheets having associated images formed thereon, and FIG. 8D illustrates a saddle-stitch processing operation for saddle-stitching a bundle of the sheets.

When a saddle stitching mode is set on the configuration screen 700, an image forming order and image forming positions of the image data items R1 to R8 for 8 pages are determined as shown in FIG. 8A. As a consequence, as shown in FIG. 8B, an image associated with the image data item R4 is formed on the left half of a first side (front side) of a first sheet (sheet P1), and an image associated with the image data item R5 is formed on the right half of the same. Further, an image associated with the image data item R6 is formed on the left half of a second side (reverse side) of the sheet P1, and an image associated with the image data item R3 is formed on the right half of the same.

The sheet P1 having the images formed on the opposite sides thereof is conveyed in a direction indicated by an arrow in FIG. 8C, with a second side on which the images associated with the respective image data items R6 and R3 are formed facing upward, and with the image associated with the image data item R6 in the leading position, as shown in FIG. 8C. Thereafter, processing for a second sheet is started. As shown in FIG. 8B, an image associated with the image data item R2 is formed on the left half of a first side (front side) of the second sheet (sheet P2), and an image associated with the image data item R7 is formed on the right half of the same. Further, an image associated with the image data item R8 is formed on the left half of a second side (reverse side) of the sheet P2, and an image associated with the image data item R1 is formed on the right half of the same.

As shown in FIG. 8D, a thrusting member of the saddle stitcher 28 is thrust against a sheet bundle formed by the sheets P1 and P2 having the images formed thereon. As a consequence, the sheet bundle is pushed toward a folding roller pair. The sheet bundle pushed toward the folding roller pair is folded about a central portion (which corresponds to a boundary between the images on each of the image-formed surfaces) by the folding roller pair, and then delivered to the square back-forming section 23.

Figure 9A:
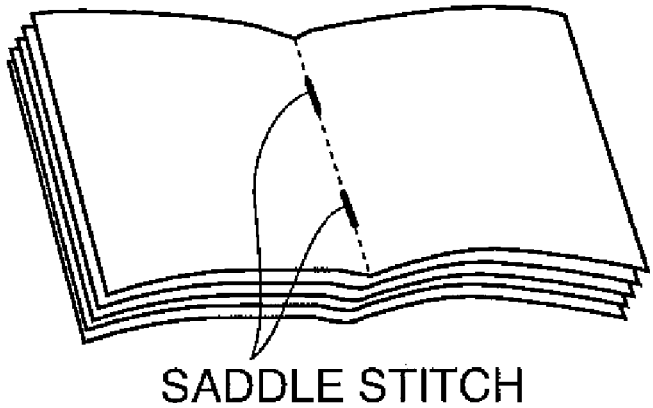
FIG. 9A is a perspective view showing an example of a saddle-stitched brochure without a square back, illustrating a printout in an opened state.
Figure 9B:
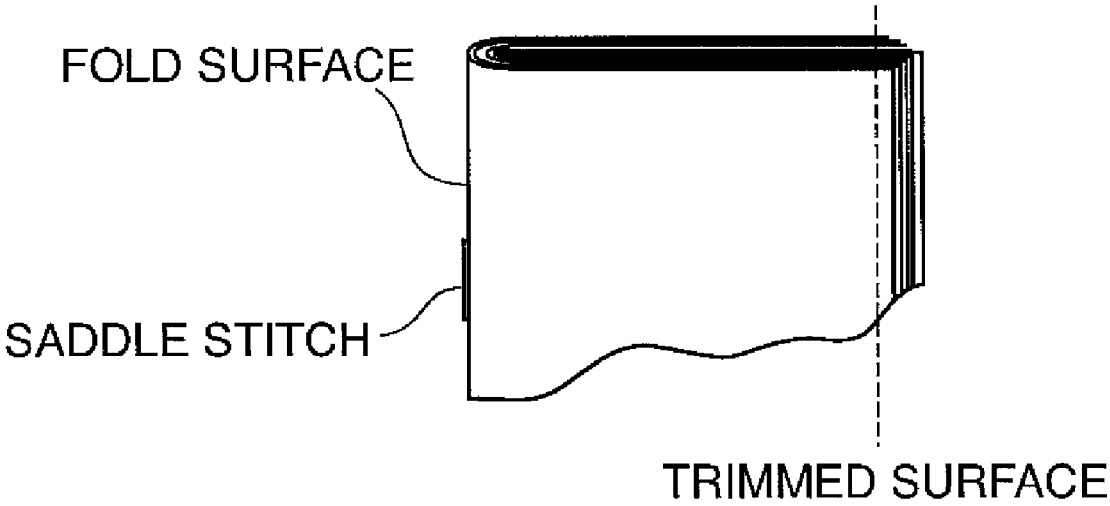
FIG. 9B is a perspective view showing the saddle-stitched brochure without a square back, illustrating a fold surface and a saddle stitch of the printout in a closed state.

The thus folded sheet bundle is formed into a printout shown in FIGS. 9A and 9B by way of example. FIG. 9A shows a saddle-stitched brochure without a square back in an opened state, and FIG. 9B shows a folding surface and a saddle stitch of the saddle-stitched brochure in a closed state. A trimmed surface denoted in FIG. 9B corresponds to a trimming position set in the case of trimming the sheet bundle by the trimmer 29.

The printing system 1000 according to the present embodiment includes the printer section 203 and the saddle stitcher 28, appearing in FIG. 4, which is capable of saddle-stitch processing of a sheet bundle having undergone print processing by the printer section 203. Further, the printing system 1000 includes the square back-forming section 23, appearing in FIG. 4, which is capable of performing square back processing for forming a flat surface on the back of a sheet bundle saddle-stitched by the saddle stitcher 28. Further, the printing system 1000 includes the cutter 30, appearing in FIG. 4, which is capable of performing trimming processing for trimming ends of sheets subjected to saddle-stitch processing by the saddle stitcher 28. These units function as a printing unit, a saddle stitching unit, a working unit, and trimming means, respectively.

Thus, the printing system 1000 according to the present embodiment is configured to be capable of forming a saddle-stitched brochure subjected to the square back processing and trimming processing using the above-mentioned units. The saddle-stitched brochure has its back formed with a flat surface, and an end (edge) opposite from the back trimmed. In the present embodiment, a job for creating a saddle-stitched brochure is categorized as a first-type job and the controller 205 performs control such that the printing system 1000 can execute processing required for the first-type job.

The printing system 1000 according to the present embodiment can also create a saddle-stitched brochure not subjected to square back processing and trimming processing, using the saddle stitcher 28 and the cutter 30. The saddle-stitched brochure has a back not formed with a flat surface and an end opposite from the back trimmed. In the present embodiment, this type of saddle-stitched brochure is categorized as a saddle-stitched brochure of a second type, and a job for creating a printout in this form is categorized as a second-type job. The controller 205 performs control such that the printing system 1000 can also execute processing required for the second-type job.

In the present invention, the controller 205 functions as a control unit. For example, the controller 205 controls (adjusts) a trimming position on an edge of a sheet bundle for a job to be processed by the printing system 1000 and/or image printing positions on respective sheets forming the sheet bundle for the job, based on whether or not the job requires square back processing. To perform an operation in accordance with this control, the printing system 1000 according to the present embodiment is equipped with various configurations, which will be described in the present first embodiment and a second embodiment described hereinafter.

When a job to be processed by the printing system 1000 is a second-type job not requiring square back processing, the controller 205 permits the cutter 30 appearing in FIG. 4 to trim an edge of a sheet bundle for the job by a predetermined trimming amount.

On the other hand, when a job to be processed by the printing system 1000 is a first-type job requiring square back processing, the controller 205 performs control such that the cutter 30 is inhibited from trimming the edge of a sheet bundle for the job by the predetermined trimming amount. To perform an operation in accordance with this control, the printing system 1000 according to the present embodiment is equipped with various configurations which will be described in the first embodiment.

It should be noted that in the present embodiment, the above-mentioned predetermined trimming amount is set to a value specified by the operator such that the value is not allowed for a first-type job (corresponding to a saddle-stitch job with square back processing), but is allowed for a second-type job (corresponding to a saddle-stitch job without square back processing). In the printing system 1000 according to the present embodiment, the range of specific numerical values of the predetermined trimming amount is set to be not smaller than 10.0 mm and smaller than 20.0 mm.

When a job to be processed by the printing system 1000 is a second-type job not requiring square back processing, the controller 205 permits the cutter 30 appearing in FIG. 4 to trim the edge of a sheet bundle for the job by a first trimming amount the range of which includes the range of the predetermined trimming amount.

On the other hand, when a job to be processed by the printing system 1000 is a first-type job requiring square back processing, the controller 205 performs the following control: The controller inhibits the cutter 30 from trimming the edge of a sheet bundle for the job by the aforementioned predetermined trimming amount, but permits the cutter 30 to trim the edge of the sheet bundle by a second trimming amount larger than the predetermined trimming amount. To perform an operation in accordance with this control, the printing system 1000 according to the present embodiment is equipped with various configurations, which will be described in the first embodiment.

It should be noted that in the present embodiment, the above-mentioned first trimming amount is set to a value specified by the operator such that the value is selected from a range including the range of the predetermined trimming amount not allowed for a first-type job but allowed for a second-type job. In the printing system 1000 according to the present embodiment, the range of specific numerical values of the first trimming amount is set to be not smaller than 10.0 mm and not larger than 30.0 mm (see [Rule 1-1] in FIG. 25).

On the other hand, the second trimming amount is set to a value specified by the operator such that the value is selected from a range which is allowed both for a first-type job and for a second-type job but is exclusive of the range of the predetermined trimming amount. In the printing system 1000 according to the present embodiment, the range of specific numerical values of the second trimming amount is set to be not smaller than 20.0 mm and not larger than 30.0 mm (see [Rule 1-2] in FIG. 25). The controller 205 functions based on [Rule 1-1] and [Rule 1-2] described in a management table 2400 in FIG. 25 registered in advance in a predetermined memory of the printing apparatus 100, whereby the above control is executed.

Further, assume a case where a job to be processed by the printing system 1000 is a second-type job not requiring square back processing. In this case, the controller 205 permits the printer section 203 to perform print processing on sheets for the job based on a predetermined correction amount (creep correction amount) set for correcting a shift in image position between outer sheets and inner sheets of an associated saddle-stitched brochure.

On the other hand, when a job to be processed by the printing system 1000 is a first-type job requiring square back processing, the controller 205 performs control such that the printer section 203 is inhibited from performing print processing on sheets for the job based on the predetermined creep correction amount. To perform an operation in accordance with this control, the printing system 1000 according to the present embodiment is equipped with various configurations, which will be described hereinafter in the second embodiment.

It should be noted that in the present embodiment, the above-mentioned predetermined creep correction amount is set to a value specified by the operator such that the value is not allowed for a first-type job (corresponding to a saddle-stitch job with square back processing), but allowed for a second-type job (corresponding to a saddle-stitch job without square back processing). In the printing system 1000 according to the present embodiment, the range of specific numerical values of the predetermined creep correction amount is set to be not smaller than 0.10 mm and smaller than 0.20 mm.

Further, assume a case where a job to be processed by the printing system 1000 is a second-type job not requiring square back processing. In this case, the controller 205 permits the printer section 203 to perform print processing on sheets for the job based on a first creep correction amount the range of which includes the range of the predetermined creep correction amount for correcting a shift in image position between outer sheets and inner sheets of the saddle-stitched brochure.

Assume, on the other hand, a case where a job to be processed by the printing system 1000 is a first-type job requiring square back processing. In this case, the controller 205 performs control such that the printer section 203 is inhibited from performing print processing on sheets for the job by the predetermined creep correction amount, but by a second creep correction amount larger than the predetermined creep correction amount. To perform an operation in accordance with this control, the printing system 1000 according to the present embodiment is equipped with various configurations, which will be described in the second embodiment.

It should be noted that in the present embodiment, the above-mentioned first creep correction amount is set to a value specified by the operator such that the value is selected from a range including the range of the predetermined creep correction amount not allowed for a first-type job but allowed for a second-type job. In the printing system 1000 according to the present embodiment, the range of specific numerical values of the first creep correction amount is set to be not smaller than 0.10 mm and not larger than 10.00 mm (see [Rule 2-1] in FIG. 25).

On the other hand, the second creep correction amount is set to a value specified by the operator such that the value is selected from a range which is allowed both for a first-type job and for a second-type job but is exclusive of the range of the predetermined creep correction amount. In the printing system 1000 according to the present embodiment, the range of specific numerical values of the second creep correction amount is set to be not smaller than 0.20 mm and not larger than 10.00 mm (see [Rule 2-2] in FIG. 25). The controller 205 functions based on [Rule 2-1] and [Rule 2-2] described in the management table 2400 in FIG. 25, whereby the above control is executed.

Further, assume a case where a job to be processed by the printing system 1000 is a second-type job not requiring square back processing. In this case, the controller 205 permits the printer section 203 to perform print processing on sheets for the job based on the predetermined creep correction amount, and at the same time permits the cutter 30 to trim the edge of a sheet bundle formed by the sheets for the job, by the predetermined trimming amount.

Assume, on the other hand, a case where a job to be processed by the printing system 1000 is a first-type job requiring square back processing. In this case, the controller 205 performs control such that the printer section 203 is inhibited from performing print processing on sheets for the job based on the predetermined correction amount, and at the same time the cutter 30 is inhibited from trimming the edge of a sheet bundle formed by the sheets for the job, by the predetermined trimming amount. To perform an operation in accordance with this control, the printing system 1000 according to the present embodiment is equipped with various configurations, which will be described in the first embodiment and in the second embodiment described hereinafter. Further, in the present embodiment, the controller 205 functions based on the four rules of [Rule 1-1] to [Rule 2-2] described in the management table 2400 in FIG. 25, whereby the above control is executed.

Further, assume a case where a job to be processed by the printing system 1000 is a second-type job not requiring square back processing. In this case, the controller 205 permits the printer section 203 to perform print processing on sheets for the job based on the aforementioned first creep correction amount, and at the same time permits the cutter 30 to trim the edge of a sheet bundle formed by the sheets for the job, by the aforementioned first trimming amount.

Assume, on the other hand, a case where a job to be processed by the printing system 1000 is a first-type job requiring square back processing. In this case, the controller 205 performs control such that the printer section 203 is inhibited from performing print processing on sheets for the job based on the predetermined creep correction amount, but is permitted to perform print processing on the sheets based on the aforementioned second creep correction amount. At the same time, the controller 205 performs control such that the cutter 30 is inhibited from trimming the edge of a sheet bundle formed by the sheets for the job, by the predetermined trimming amount, but is permitted to trim the edge of the sheet bundle by the aforementioned second trimming amount. To perform an operation in accordance with this control, the printing system 1000 according to the present embodiment is equipped with various configurations, which will be described in the first embodiment and in the second embodiment described hereinafter. Further, in the present embodiment, the controller 205 functions based on four rules of [Rule 1-1] to [Rule 2-2] described in the management table 2400 in FIG. 25, whereby the above control is executed.

The controller 205 in the present embodiment performs control such that the operator is permitted to set the predetermined trimming amount for a second-type job via a user interface (hereinafter simply referred to "the UI"). On the other hand, the controller 205 performs control such that the operator is inhibited from setting the predetermined trimming amount for a first-type job via the UI. To perform an operation in accordance with this control, the printing system 1000 according to the present embodiment is equipped with various configurations described below in the first embodiment. In the present embodiment, the controller 205 functions based on [Rule 1-1] and [Rule 1-2] described in the management table 2400 in FIG. 25, whereby the above control is executed.

Further, the controller 205 in the present embodiment performs control such that the operator is permitted to set the predetermined creep correction amount for a second-type job via the UI. On the other hand, the controller 205 performs control such that the operator is inhibited from setting the predetermined creep correction amount for a first-type job via the UI. To perform an operation in accordance with this control, the printing system 1000 according to the present embodiment is equipped with the various configurations which will be described hereinafter in the second embodiment, and the controller 205 functions based on [Rule 2-1] and [Rule 2-2] described in the management table 2400 in FIG. 25, whereby the above control is executed.

Further, assume a case where a job to be processed by the printing system 1000 is a first-type job requiring square back processing. In this case, the controller 205 in the present embodiment performs control such that trimming of the edge of a sheet bundle for the job by the predetermined trimming amount is inhibited and/or such that execution of print processing on sheets forming the sheet bundle for the job, based on the predetermined creep correction amount, is inhibited. As described hereinabove, these predetermined trimming amount and predetermined creep correction amount are allowed only for a second-type job, and hence controlled (adjusted) by the controller 205 such that they are by no means allowed for a first-type job.

As one example of the above-described control, the controller 205 may cause the UI to display a warning message. Further, as another example of the above-described control, the controller 205 may perform control such that the operator can change settings for a first-type job via the UI. As still another example of the above-described control, the controller 205 may cancel the first-type job. In the present embodiment, "to cancel processing for the job" includes "to inhibit square back processing required for the job". Further, it includes not only "to inhibit saddle-stitch processing required for the job", but also "to inhibit print processing required for the job". Furthermore, it includes "to erase data for a job from the HDD 209 after cancellation of associated print processing".

As described above, when the trimming amount and/or the creep correction amount is not properly set for a job to be processed, the controller 205 inhibits (cancels) not only square back processing and saddle-stitch processing configured for the job, but also print processing. This configuration makes it possible to construct an environment further matched with a working site under a POD environment for delivering brochures as commercial articles in response to a request from a customer. Further, by inhibiting creation of a brochure which does not match a customer's request and printout per se for the brochure, it is possible to provide a printing environment which makes it possible to output a plurality of jobs in forms desired by a customer, with high productivity, without waste of time and costs.

The management table 2400 in FIG. 25 is management data describing data defining rules concerning the saddle-stitch job not requiring square back processing (second-type job) and the saddle-stitch job requiring square back processing (first-type job) as two major categories of the saddle-stitch job. More specifically, for each type of these jobs, there is described data defining a rule on the trimming amount (first-type restricting conditions) and a rule on the creep correction amount (second-type restricting conditions). The management table 2400 is used by the controller 205, and how it is used is in the description given hereinabove, and a description given hereinafter, and hence description thereof is omitted here.

It should be noted that the specific numerical values mentioned in the management table 2400 are only given by way of example, and the present invention is not limited to these. As in the printing system 1000 according to the present embodiment, the management table 2400 is desirably configured such that it is possible to maintain a rule of the lower limit value of the trimming amount allowed for the saddle-stitch job with square back processing being larger than the lower limit value of the trimming amount allowed for the saddle-stitch job without square back processing. Further, As in the printing system 1000 according to the present embodiment, the management table 2400 is desirably configured such that it is possible to maintain a rule of the lower limit value of the creep correction amount allowed for the saddle-stitch job with square back processing being larger than the lower limit value of the creep correction amount allowed for the saddle-stitch job without square back processing. Further, it is desirable to control the system according to these rules.

First, differences between a case where square back processing is executed and a case where square back processing is not executed will be described with reference to FIGS. 10A to 10D.

Figure 10A:
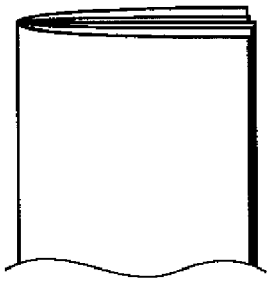
FIG. 10A is a perspective view of the appearance of a saddle-stitched brochure formed by a set of a smaller number of sheets.
Figure 10B:
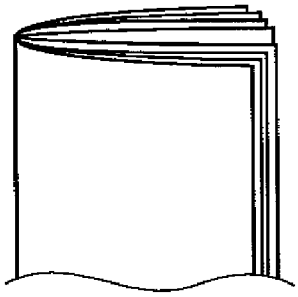
FIG. 10B is a perspective view of the appearance of a saddle-stitched brochure formed by a set of a larger number of sheets.

FIG. 10A is a perspective view of the appearance of a saddle-stitched brochure formed by a set of a smaller number of sheets, while FIG. 10B is a perspective view of the appearance of a saddle-stitched brochure formed by a set of a larger number of sheets. It should be noted that the saddle-stitched brochures in FIGS. 10A and 10B have not undergone square back processing. As is apparent from a comparison between FIG. 10A and FIG. 10B, when the number of sheets is large, a saddle-stitched brochure has an arcuate bulge as a portion of a sheet bundle extending from the back thereof toward the front end (fore edge) thereof.

Figure 10C:
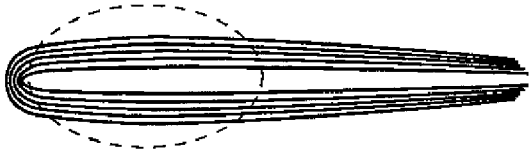
FIG. 10C is a cross-sectional view of a saddle-stitched brochure not subjected to square back processing.
Figure 10D:
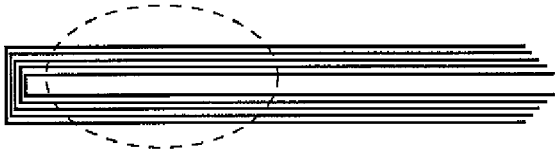
FIG. 10D is a cross-sectional view of a saddle-stitched brochure subjected to square back processing.

On the other hand, FIG. 10C is a cross-sectional view of a saddle-stitched brochure not subjected to square back processing, while FIG. 10D is a cross-sectional view of a saddle-stitched brochure subjected to square back processing. As is apparent from the comparison between FIG. 10C and FIG. 10D, in a saddle-stitched brochure not subjected to square back processing, a portion enclosed by a dotted circle bulges, whereas in a saddle-stitched brochure subjected to square back processing, a portion enclosed by a dotted circle does not bulge, and a back thereof is flattened. Thus, to execute square back processing depending on the number of sheets of a saddle-stitched brochure printout to be processed has merits of improved appearance and stackability of the brochure. The printing system 1000 according to the present embodiment is configured to be capable of creating both of such a saddle-stitched brochure without a square back and a saddle-stitched brochure with a square back.

Next, a shift between an outer sheet and an inner sheet included in one set of printed sheets for a saddle-stitched printout will be described with reference to FIGS. 11A to 11D.

Figure 11A:
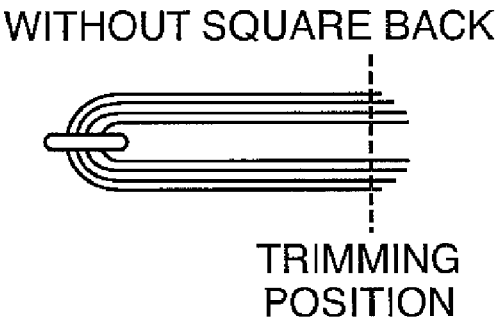
FIG. 11A is a cross-sectional view of a saddle-stitched brochure without a square back, which is useful in explaining the difference between a saddle-stitched brochure with a square back and a saddle-stitched brochure without a square back.
Figure 11B:
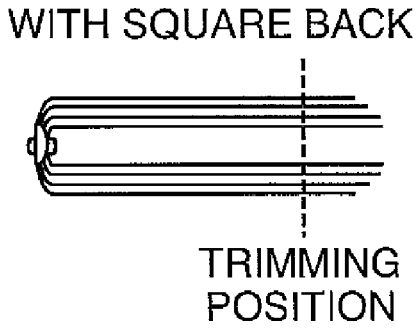
FIG. 11B is a cross-sectional view of a saddle-stitched brochure with a square back, which is useful in explaining the difference between the saddle-stitched brochure with a square back and the saddle-stitched brochure without a square back.
Figure 11C:
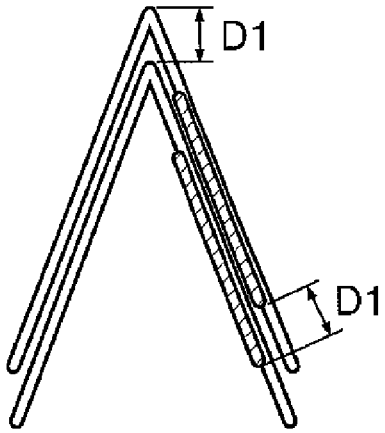
FIG. 11C is a cross-sectional view of a saddle-stitched brochure without a square back, which is useful in explaining the difference between the saddle-stitched brochure with a square back and the saddle-stitched brochure without a square back.
Figure 11D:
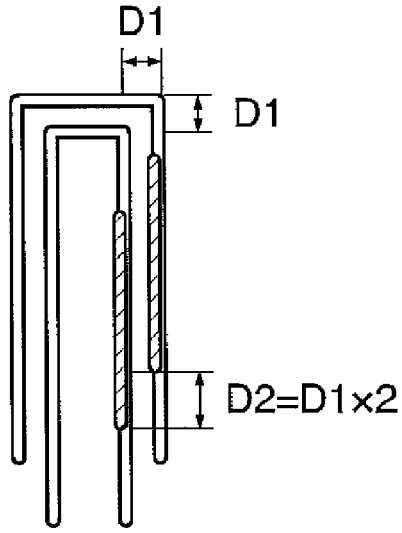
FIG. 11D is a cross-sectional view of a saddle-stitched brochure with a square back, which is useful in explaining the difference between the saddle-stitched brochure with a square back and the saddle-stitched brochure without a square back.

FIGS. 11A and 11C are cross-sectional views each showing a saddle-stitched brochure without a square back, and FIGS. 11B and 11D are cross-sectional views each showing a saddle-stitched brochure with a square back. As shown in FIGS. 11A to 11D, a positional shift is caused between an outer sheet and an inner sheet of a saddle-stitched brochure, apparently from a fore edge of the saddle-stitched brochure, according to a thickness per sheet of the saddle-stitched brochure. It should be noted that the fore edge is a portion of the saddle-stitched brochure opposite from the back thereof, i.e. a portion to be subjected to trimming by the cutter 30 in FIG. 4.

As shown in FIGS. 11A and 11C, when a saddle-stitched brochure does not have a square back, a sheet shift in the fore edge of the saddle-stitched brochure occurs in a manner such that an inner sheet projects from an adjacent outer sheet by an amount substantially proportional to the thickness per sheet of the saddle-stitched brochure. On the other hand, as shown in FIGS. 11B and 11D, when a saddle-stitched brochure has a square back, a sheet shift in the fore edge of the saddle-stitched brochure occurs in a manner such that an inner sheet projects from an adjacent outer sheet by an amount approximately twice as large as the shift amount in the case where a saddle-stitched brochure does not have a square back. More specifically, if a shift amount per sheet in the case where a saddle-stitched brochure does not have a square back is represented by D1, a shift amount D2 per sheet in the case where a saddle-stitched brochure has a square back can be expressed as D2=D1×2.

As is apparent from this, in trimming the fore edge of a saddle-stitched brochure according to the position of an outermost sheet (cover sheet) included in one set of printed sheets of the saddle-stitched brochure, when the brochure has a square back, it is required to trim the fore edge by a larger amount than when the brochure does not have a square back. If trimming is performed by the same trimming amount irrespective of whether or not a brochure is formed with a square back, there can arise a problem that outer sheets of a brochure with a square back cannot be trimmed. In view of this, in the present first embodiment, the controller 205 performs control such that it is possible to prevent occurrence of a trouble of inadvertently creating a saddle-stitched brochure defective in the appearance of a trimmed edge, which is caused due to the flexibility of setting of whether to execute square back processing or not. To perform an operation in accordance with this control, the printing system 1000 is equipped with configurations described below.

First, examples of trimming amount-setting screens in the respective cases of the saddle-stitched brochure without a square back and the saddle-stitched brochure with a square back of one will be described with reference to FIGS. 12 to 14. It should be noted that in the present embodiment, the controller 205 controls the touch panel section 401 of the operating section 204 to display various kinds of screens, described hereafter, in response to respective various triggers exemplified below.

Figure 12:
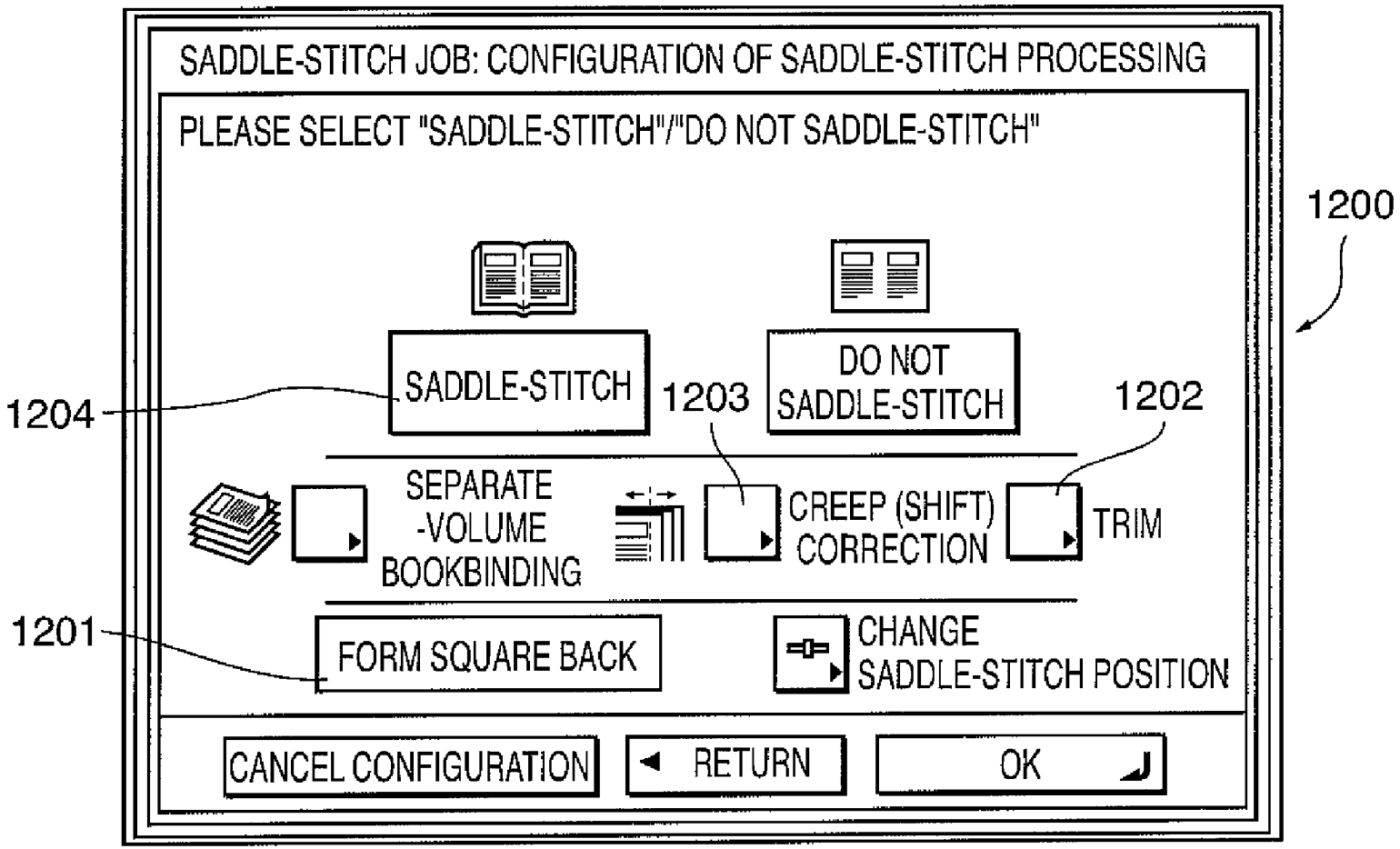
FIG. 12 is a view showing an example of a saddle-stitch job configuration screen which is displayed on a touch panel section.

FIG. 12 is a view showing an example of a saddle-stitch job configuration screen which is caused to be displayed on the touch panel section 401 by the controller 205 in response to operator's pressing of the saddle-stitch mode key 705.

The printing system 1000 according to the present embodiment is configured such that the operator can configure settings as to whether or not to execute saddle-stitch processing, settings for separate-volume bookbinding, settings for trimming, settings for adjustment (control) of saddle-stitching positions, and so forth, via the saddle-stitch job configuration screen 1200 shown in FIG. 12. This saddle-stitch job configuration screen 1200 is configured to display a "Form square back" button 1201 to be used by the operator to give an instruction for executing square back processing for a saddle-stitch job to be processed. The controller 205 is responsive to operations of these buttons, and controls contents to be displayed on the touch panel section 401 based on information of the management table 2400 in FIG. 25.

For example, assume a case where the operator presses an "Saddle-stitch" button 1204 on the saddle-stitch job configuration screen 1200 in FIG. 12 and then presses an "Trim edge" button 1202 without pressing the "Form square back" button 1201 (i.e. without giving an instruction for executing square back processing). In this case, the controller 205 performs control based on the operator's operations and the rules described in the management table 2400, such that the trimming amount-setting screen 1300 shown in FIG. 13 is displayed on the touch panel section 401. The operator can use this trimming amount-setting screen 1300 in FIG. 13 to set a trimming amount in trimming processing to be executed for a saddle-stitch job without square back processing.

Figure 13:
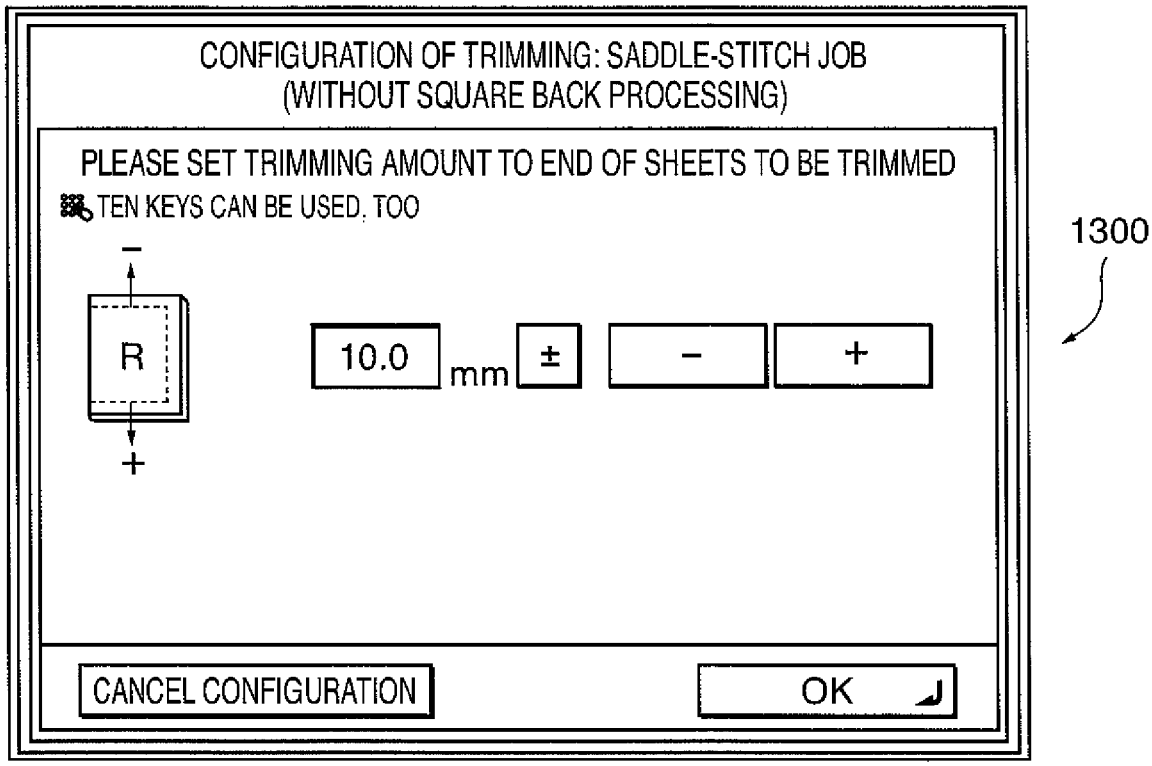
FIG. 13 is a view of an example of a trimming amount-setting screen (for processing without square back processing) displayed via the saddle-stitch job configuration screen.

In the case of causing the touch panel section 401 to display the trimming amount-setting screen 1300 in FIG. 13, the controller 205 performs control such that a default value "10.0 mm" corresponding to a minimum value (lower limit value) of the trimming amount settable for the saddle-stitch job without square back processing is displayed on the trimming amount-setting screen 1300. It should be noted that the minimum value of the trimming amount displayed on the trimming amount-setting screen 1300 may be a fixed value obtained by directly using information described in the management table 2400, or a dynamic value calculated by the controller 205 based on the number of sheets required for a saddle-stitch job to be processed and the type of the sheets. A "Correct creep (shift)" button 1203 will be described hereinafter.

On the other hand, assume a case where the operator presses the "Saddle-stitch" button 1204 on the saddle-stitch job configuration screen 1200 in FIG. 12, and then presses the "Form square back" button 1201, followed by pressing the "Trim edge" button 1202 (i.e. after giving an instruction for executing square back processing). In this case, the controller 205 performs control based on the operator's operations and the rules described in the management table 2400, such that the trimming amount-setting screen 1400 shown in FIG. 14 is displayed on the touch panel section 401. The operator can use this trimming amount-setting screen 1400 in FIG. 14 to set a trimming amount in trimming processing to be executed for a saddle-stitch job with square back processing.

Figure 14:
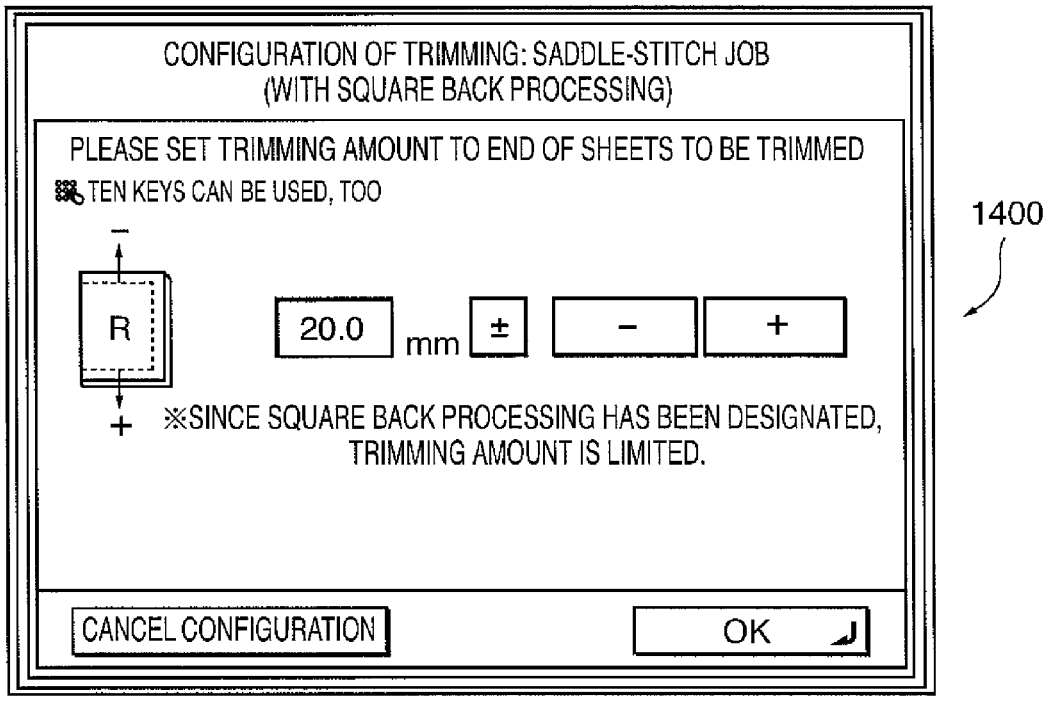
FIG. 14 is a view of an example of a trimming amount-setting screen (for processing with square back processing) displayed via the saddle-stitch job configuration screen.

In the case of causing the touch panel section 401 to display the trimming amount-setting screen 1400 in FIG. 14, the controller 205 performs control such that a default value "20.0 mm" corresponding to a minimum value (lower limit value) of the trimming amount settable for the saddle-stitch job with square back processing is displayed on the trimming amount-setting screen 1300. This is because when a saddle-stitched brochure has a square back, the positional shift amount between an inner sheet and an outer sheet of the saddle-stitched brochure is twice as large as that in a case where a saddle-stitched brochure does not have a square back, as described hereinabove. This control makes it possible to prevent a brochure from being output with outer sheets left uncut against the operator's intention.

Figure 15:
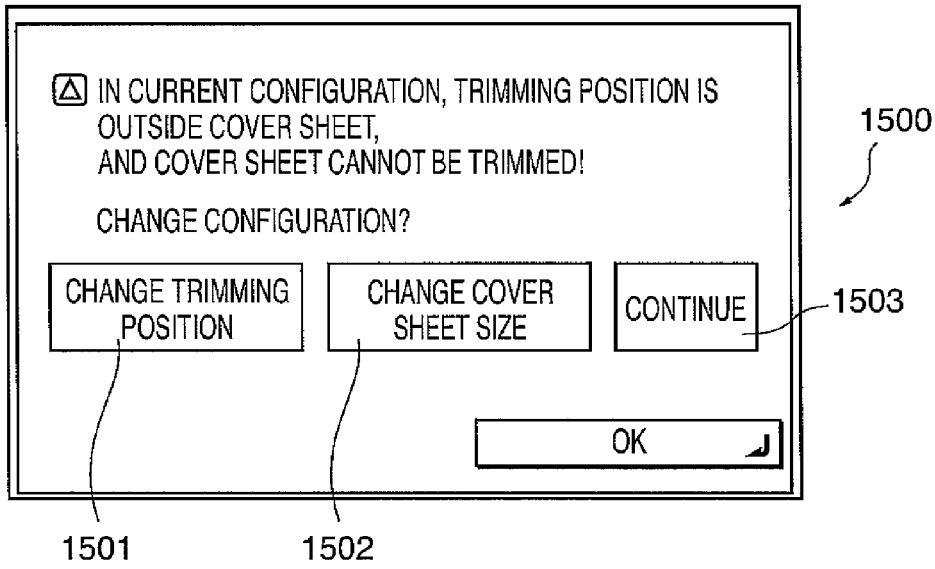
FIG. 15 is a view of an example of a warning screen displayed according to a trimming amount set on the screens shown in FIGS. 12 and 13.

FIG. 15 is a view of an example of a warning screen displayed according to a trimming amount set on the screens shown in FIGS. 12 and 13.

As described hereinabove, the positional shift amount between an outer sheet and an inner sheet of a saddle-stitched brochure varies with the number and type (thickness per sheet) of sheets forming the saddle-stitched brochure. For this reason, an event can occur in which outer sheets of a saddle-stitched brochure are not trimmed by a trimming amount set on the configuration screens. Further, even when a maximum value of the trimming amount indicative of the upper limit of the same is set, the outer sheets can be left uncut, depending on a combination of the sheet type and the sheet size. To cope with this event, when an "OK" button is pressed on the screen in FIG. 13 or 14, a comparison is performed between a set value of the trimming amount and the amount of a positional shift between the outermost sheet and the innermost sheet, which is determined based on the number of sheets (sheet count) and the sheet type set for saddle stitching, and if the amount of the positional shift is larger than the set value of the trimming amount, the warning screen 1500 shown in FIG. 15 is displayed. From this warning screen 1500, the operator can select to change the set value of the trimming amount (i.e. a trimming position), change the size of a sheet (e.g. a cover sheet) used for printing, or continue print processing without changing the settings.

When a "Change trimming position" button 1501 is selected, the configuration screen shown in FIG. 13 or 14 is displayed, whereby the operator is permitted to change the setting of the trimming position. When a "Change cover sheet size" button 1502 is selected, a sheet size setting screen, not shown, is displayed, whereby the operator is permitted to change the setting of the cover sheet size. When a "Continue" button 1503 is selected, the screen in FIG. 12 is switched to the saddle-stitch job configuration screen 1200, and configuration for saddle stitching is completed by depression of an "OK" button.

Next, a printing process including saddle-stitch processing will be described with reference to FIG. 16.

Figure 16:
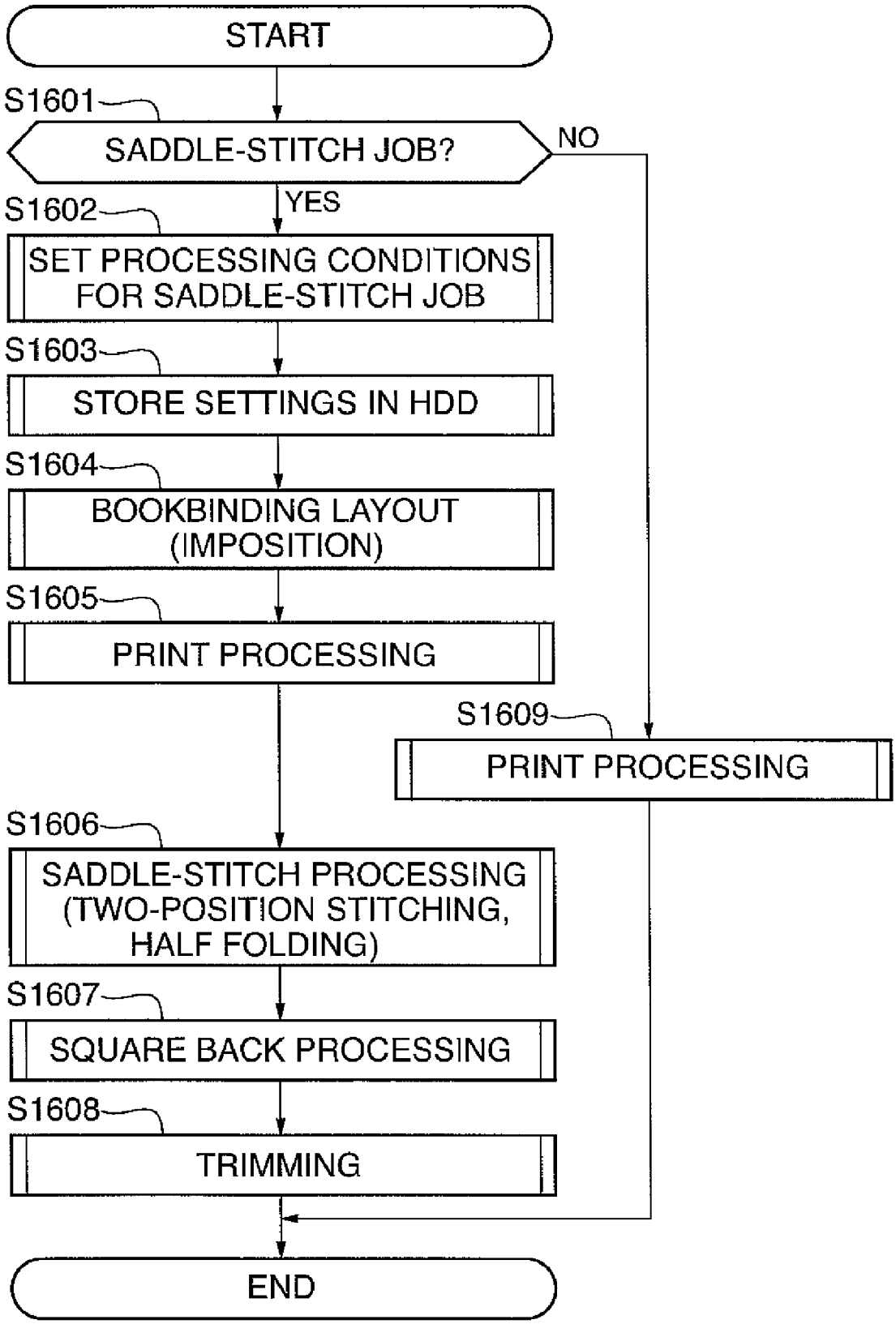
FIG. 16 is a flowchart of a printing process including saddle-stitch processing.

FIG. 16 is a flowchart of a printing process including saddle-stitch processing. The present process is executed by the controller 205 based on predetermined programs read out from the memory.

First, the controller 205 determines, e.g. based on whether or not the saddle-stitching mode key 705 has been pressed, whether or not a job to be processed is a saddle-stitch job (S1601). If the job is not a saddle-stitch job, the ordinary printing process is performed (S1609). On the other hand, if the job is a saddle-stitch job, the controller 205 causes the touch panel section 401 to display the configuration screens 700 and 1200 shown in FIGS. 7 and 12, and accepts settings of processing conditions of the saddle-stitch job (S1602). When the settings are completely configured, i.e. when an "OK" button appearing in FIG. 12 is pressed, the settings are stored in the HDD 209 (S1603).

Next, the controller 205 performs bookbinding layout (imposition) processing for the job to be processed, based on the settings stored in the HDD 209 (S1604). Thereafter, image data having undergone the bookbinding layout processing is printed by the printing apparatus 100 (S1605), and then saddle-stitch processing (two-position stitching and half folding) is executed by the sheet processing apparatus 200 (S1606). When the job to be processed includes square back processing, the square back processing is performed by the square back-forming section 23 within the sheet processing apparatus 200 (S1607). Further, if trimming processing has been designated, the trimming processing is performed by the cutter 30 (S1608), followed by a printout having undergone the trimming processing being delivered to the booklet holding section 31. It should be noted that print processing executed based on the creep correction amount, described hereinafter, is realized by the bookbinding layout processing performed using the memory in the step S1604.

Next, a method of setting the trimming amount included in the settings associated with the processing conditions for the saddle-stitch job, which are accepted in the step S1602 in FIG. 16, will be described with reference to FIG. 17.

Figure 17:
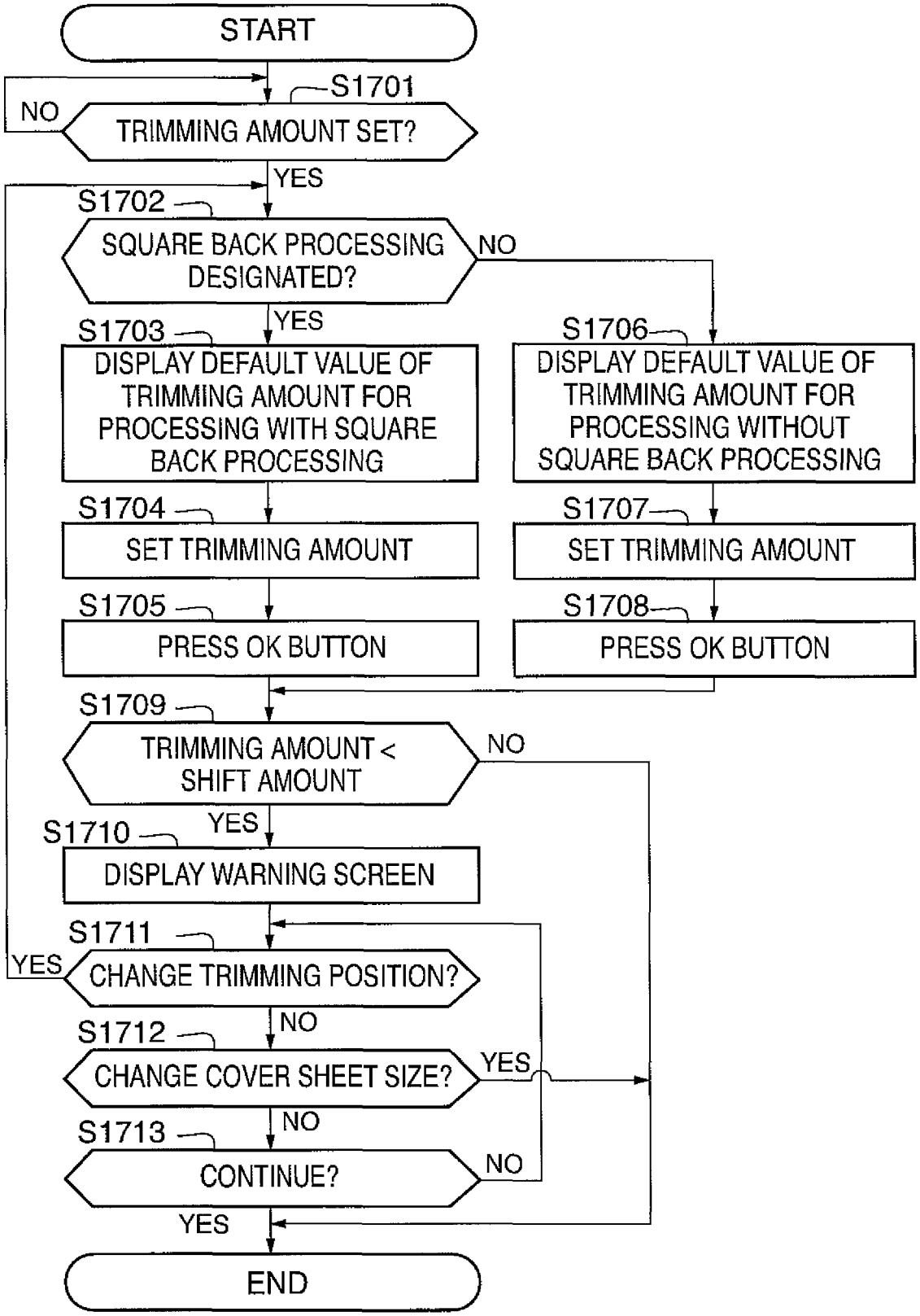
FIG. 17 is a flowchart of a trimming amount-setting process.

FIG. 17 is a flowchart of a trimming amount-setting process.

When the "Trim edge" button 1202 is selected on the saddle-stitch job configuration screen 1200 in FIG. 12 (YES to S1701), the controller 205 determines whether or not "Form square back (execute square back processing)" has been designated (S1702). If "Form square back" has been designated, the trimming amount-setting screen 1400 in FIG. 14 is displayed to display the default value of the trimming amount for saddle-stitch processing with square back processing (S1703), and the operator sets a desired trimming amount (S1704).

On the other hand, if square back processing has not been designated, the trimming amount-setting screen 1300 in FIG. 13 is displayed to display the default value of the trimming amount for the case of saddle stitch processing without square back processing (S1706), and the operator sets a desired trimming amount (S1707). In both of the case where square back processing is to be executed and the case where the same is not to be execute, if the "OK" button is pressed (S1705 or S1708), the trimming amount-setting screen 1300 or 1400 is switched to the saddle-stitch job configuration screen 1200 in FIG. 12. On the other hand, if a "Cancel configuration" button is selected, the screen is switched to the saddle-stitch job configuration screen 1200 without storing the set value of the trimming amount set by the operator.

Next, the controller 205 performs a comparison between the set trimming amount (set value of the trimming amount) and the shift amount (amount of the positional shift) (S1709). If the shift amount is larger than the trimming amount, the warning screen 1500 shown in FIG. 15 is displayed (S1710). On the other hand, if the trimming amount is larger than the shift amount, the screen is switched to the saddle-stitch job configuration screen 1200. The shift amount used for a comparison with the set trimming amount is calculated based on the settings as to whether or not to execute square back processing, a sheet count (the number of sheets), and a sheet type.

Referring to the warning screen 1500 in FIG. 15, processing is made different depending on whether the "Change trimming position" button 1501 is selected (S1711), the "Change cover sheet size" button 1502 is selected (S1712), or the "Continue" button 1503 is selected (S1713). When the "Change trimming position" button 1501 is selected, the screen is switched to the trimming amount-setting screen 1300 or 1400 in FIG. 13 or FIG. 14. When the "Change cover sheet size" button 1502 is selected, the saddle-stitch job configuration screen 1200 is closed, and the sheet size setting screen, not shown, is displayed. When the "Continue" button 1503 is selected, the screen is switched to the saddle-stitch job configuration screen 1200 in FIG. 12, and the configuration for saddle stitching is completed.

As described above, in the case of processing a job including saddle-stitch processing, the controller 205 determines whether or not the value of the trimming amount set by the operator is valid. Then, when the set value is invalid, the controller 205 displays a warning screen to warn the operator, and at the same time performs control such that the operator is permitted to change the setting, to thereby prevent wasteful printing from being performed for creation of an unintended brochure. In particular, a printout for a saddle-stitch job is trimmed based on the number of sheets required for printing in the job, the type of the sheets, and the setting as to whether or not square back processing is to be executed. This makes it possible to prevent wasteful printing from being performed for creation of a defective brochure having its outer portion (portion including a cover sheet) left uncut and only its inner (main) portion trimmed.

Next, a second embodiment of the present invention will be described in detail with reference to drawings. It should be noted that the following description will be mainly given of different points in the configuration of the second embodiment from those of the first embodiment, and description of the other points in the configuration, which are identical to the corresponding ones of the first embodiment, is omitted. In the second embodiment, the controller 205 performs control such that it is possible to prevent occurrence of a trouble of inadvertently creating a saddle-stitched brochure defective in results of printing (i.e. printed image position), which is caused due to the flexibility of setting of whether to execute square back processing or not. To perform an operation in accordance with this control, the printing system 1000 is equipped with configurations described below.

Figure 18B:
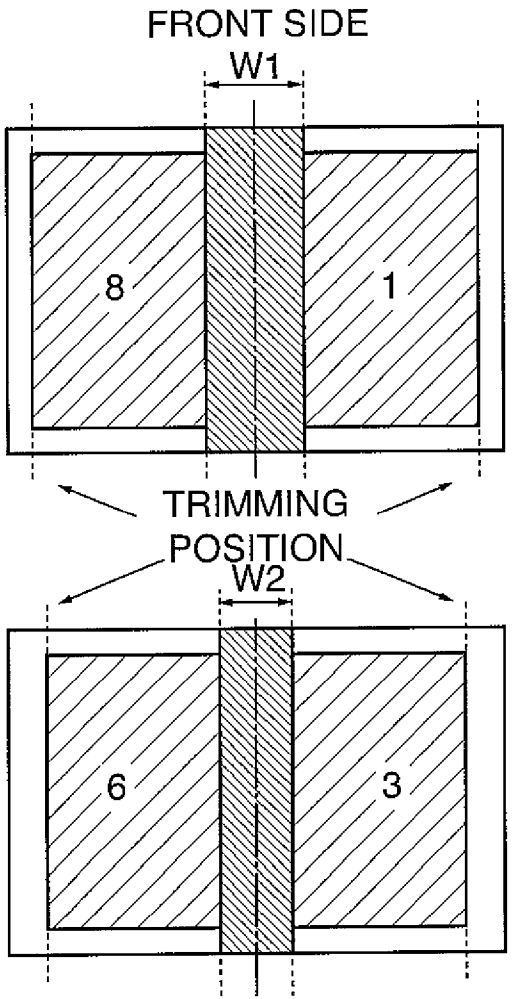
FIGS. 18A and 18B are views illustrating a print layout (surface) set in the case of saddle-stitching a sheet bundle having 8-page image data printed on sheets thereof.
Figure 18A:
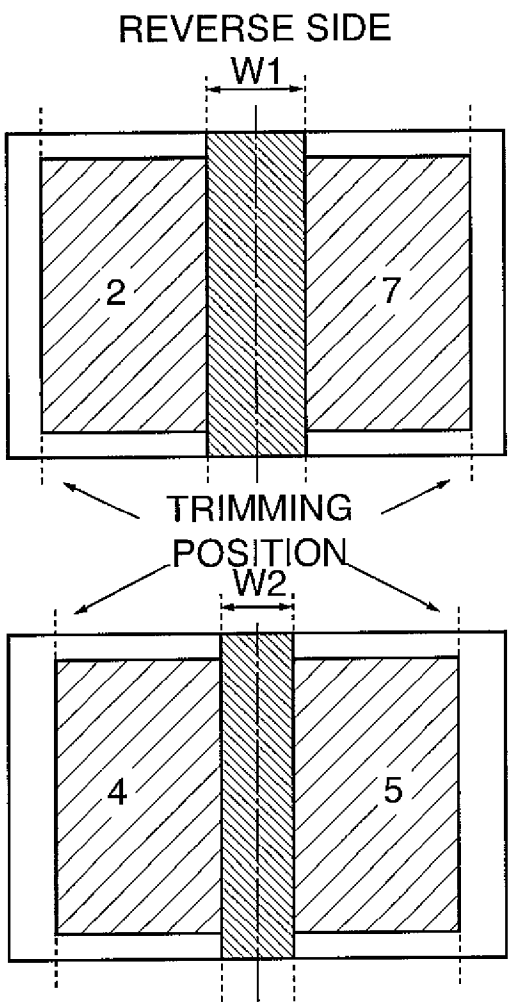

FIGS. 18A and 18B are views illustrating results of printing obtained by laying out 8 pages of image data (original data) on front and reverse sides of two sheets to form a saddle-stitched brochure from one bundle composed of two sheets.

The upper part of FIG. 18B show results of printing of a first-page image and an eighth-page image of the original data on the front side of a sheet to be finally disposed on the outer side of the saddle-stitched brochure (i.e. a sheet to be used as a cover sheet in the illustrated example). The results of the printing correspond to those on one side of the sheet P2 shown in FIG. 8D. As shown by the present results of the printing, in the case of performing saddle-stitch printing, the first-page image and the eighth-page image can be laid out on the front side of the sheet P2 (corresponding to the second side of the second sheet in FIG. 8B) with a space of W1 formed therebetween.

Similarly, the upper part of FIG. 18A shows results of printing of a second-page image and a seventh-page image of the original data on the reverse side of the sheet P2 to be finally disposed on the outer side of the saddle-stitched brochure. The results of the printing corresponds to those on the other side of the sheet P2 shown in FIG. 8D. As shown by the present results of the printing, in the case of performing saddle-stitch printing, the second-page image and the seventh-page image can be laid out on the reverse side of the sheet P2 (corresponding to the first side of the second sheet in FIG. 8B) with a space of W1 formed therebetween as on the front side.

On the other hand, the lower part of FIG. 18B shows results of printing of a third-page image and a sixth-page image of the original data on the front side of a sheet to be finally disposed on the inner side of the saddle-stitched brochure. The results of the printing correspond to those on one side of the sheet P1 shown in FIG. 8D. As shown by the present results of printing, in the case of performing saddle-stitch printing, the third-page image and the sixth-page image can be laid out on the front side of the sheet P1 (corresponding to the second side of the first sheet in FIG. 8B) with a space of W2 smaller in value than W1 formed therebetween.

Similarly, the lower part of FIG. 18A shows results of printing of a fourth-page image and a fifth-page image of the original data on the reverse side of the sheet P1 to be finally disposed on the inner side of the saddle-stitched brochure. The results of the printing result corresponds to those on the other side of the sheet P1 shown in FIG. 8D. As shown by the present results of the printing, in the case of performing saddle-stitch printing, the fourth-page image and the fifth-page image can be laid out on the reverse side of the sheet P1 (corresponding to the first side of the first sheet in FIG. 8B) with a space of W2 formed therebetween as on the front side of the sheet P1.

As described with reference to FIGS. 11A to 11D, in a saddle-stitched brochure, a shift between an outer sheet and an inner sheet is caused according to the thickness per sheet of the sheets. For this reason, if 8 pages of the image data are all printed on the sheets with the same layout, the shift dependent on the thickness per sheet of the sheets causes a shift in image position between the an inner page and an outer page. Therefore, in order to align the position of an image on an inner page over that of an image on an outer page, it is required to shift images on a sheet from the central axis thereof to respective more outward positions as the sheet becomes an outer sheet, as shown in FIGS. 18A and 18B.

Now, assume a case where 4-page images, i.e. the first-page image, the eighth-page image, the second-page image, and the seventh-page image, are laid out on the front and reverse of the sheet to be finally disposed on the outer side of the saddle-stitched brochure, as described with reference to FIGS. 18A and 18B. The present embodiment makes it possible to adjust the printing positions of the respective images in the layout processing such that images on each side of the sheet are arranged with the space of W1 formed therebetween. Similarly, assume a case where 4-page images, i.e. the third-page image, the sixth-page image, the fourth-page image, and the fifth-page image, are laid out on the front and reverse of the sheet to be finally disposed on the inner side of the saddle-stitched brochure. The present embodiment makes it possible to adjust the printing positions of the respective images in the layout processing such that images on each side of the sheet are arranged with the space of W2 smaller in value than W1 formed therebetween. The printing apparatus 100 according to the present embodiment is capable of performing bookbinding layout processing such that images to be printed in a saddle-stitched brochure can be laid out while maintaining the relation of W1>W2. The printing apparatus 100 is equipped with a creep correction amount control function, described hereinafter, as a function for realizing the above capability. Thus, it is possible to obtain an output result in which the positions of respective images on an outer sheet are shifted further outward from the central axis of the sheet than those of respective images on an inner sheet are, as shown in FIGS. 18A and 18B.

Figure 19:
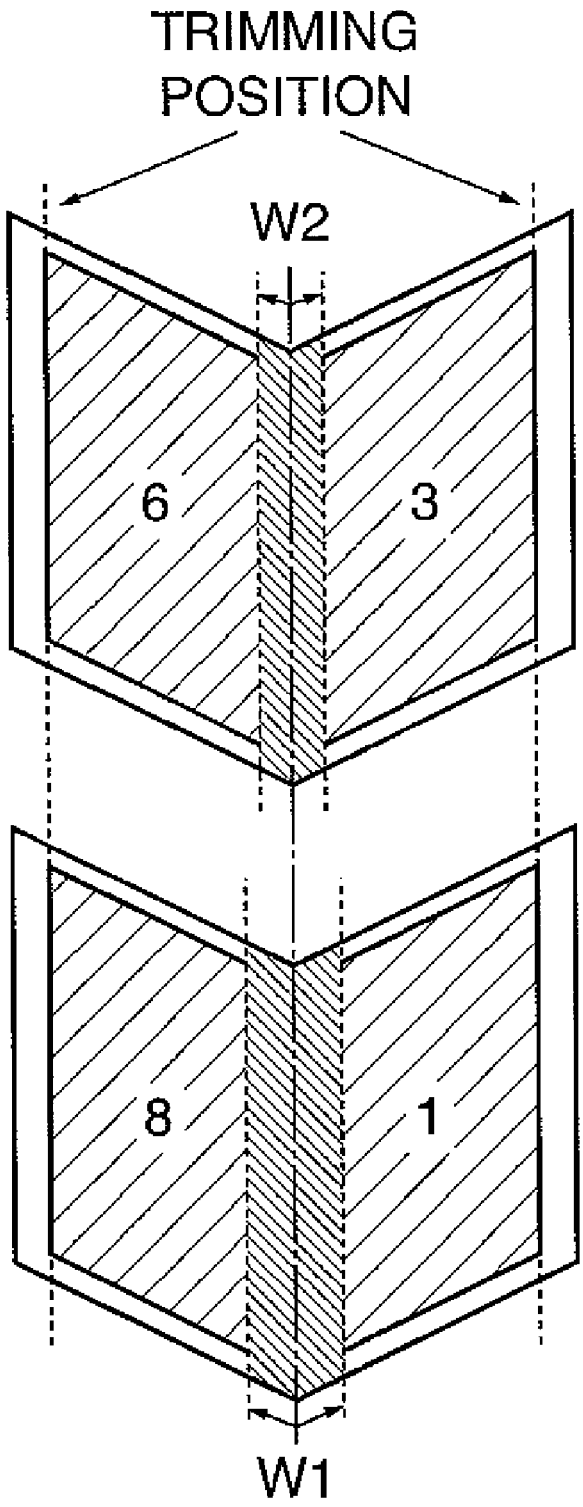
FIG. 19 is a view useful in explaining a state of each sheet of a 8-page sheet bundle folded in half.

FIG. 19 is a view useful in explaining a case in which a sheet bundle formed by the sheet P2 having the first-page, eighth-page, second-page, and seventh-page images printed thereon and the sheet P1 having the third-page, sixth-page, fourth-page, and fifth-page images printed thereon are folded in half to form one saddle-stitched brochure. FIG. 19 also explains how the saddle-stitched brochure looks after the fore edge of the saddle-stitched brochure folded in half is trimmed. It should be noted that in actuality, these sheets are saddle-stitched into one set before being folded in half, but in FIG. 19, they are shown separately for purposes of ease of understanding. Even in a case where the fore edge of a saddle-stitched brochure is trimmed, the use of the creep correction amount control function makes it possible to make all the positions of printed images as measured from the trimmed ends of the respective sheets uniform as shown in FIG. 19.

Next, an image position adjustment amount (adjustment of the creep correction amount) in adjustment of the position of an image from the central axis of a sheet will be described with reference to FIGS. 20, 21, and 22.

Figure 20:
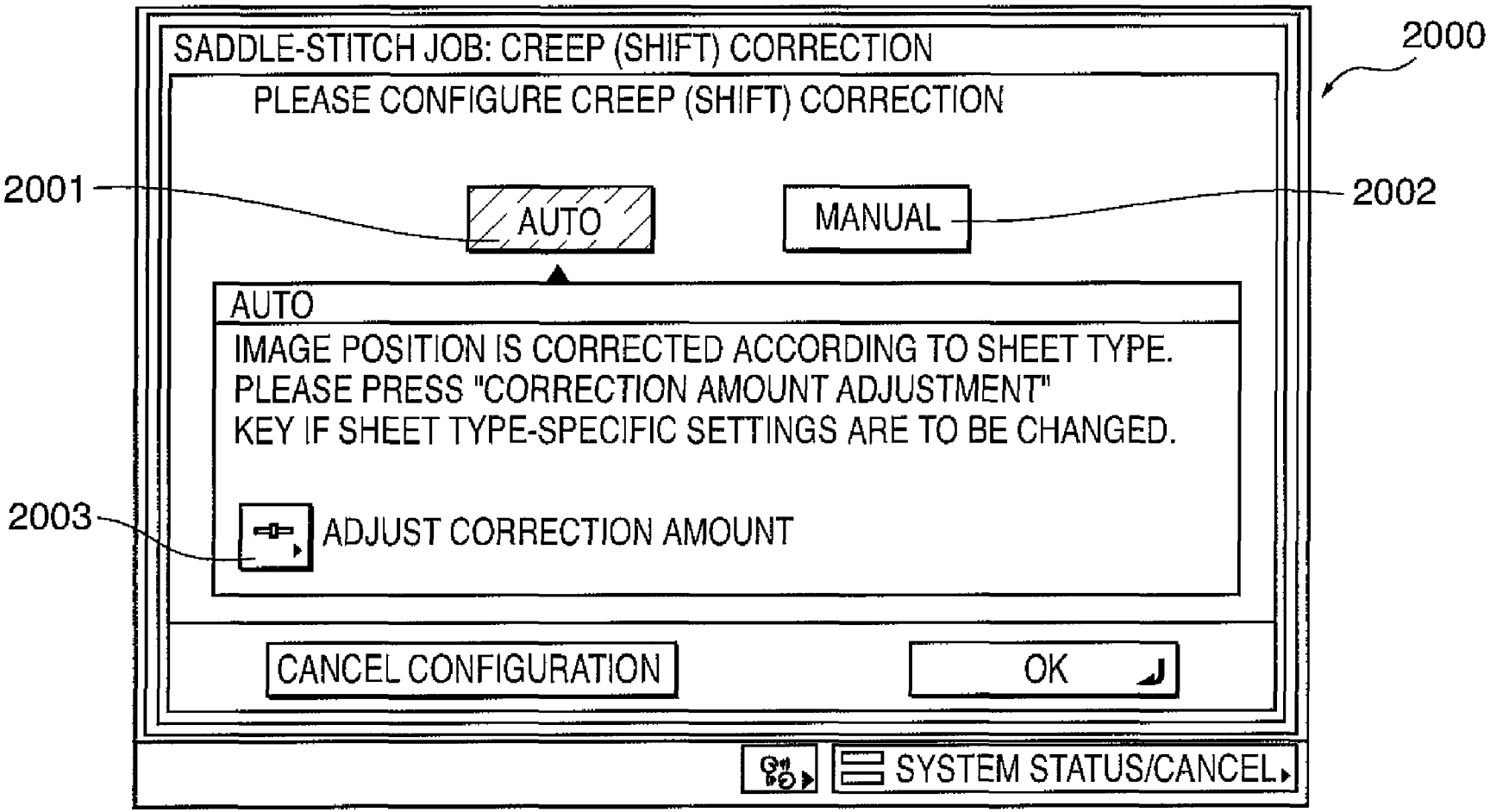
FIG. 20 is a view of an example of a creep (shift) correction amount-setting screen displayed when a "creep (shift) correction" button is pressed on the saddle-stitch job configuration screen shown in FIG. 12.

FIG. 20 is a view of an example of a creep (shift) correction amount-setting screen displayed when the "Correct creep (shift)" button 1203 is pressed on the saddle-stitch job configuration screen shown in FIG. 12.

Adjustment of the creep correction amount can be performed either automatically or manually on the creep correction amount adjustment screen 2000. Referring to FIG. 20, there is shown a case where automatic setting has been selected by pressing an "Auto" button 2001. When automatic setting is selected, the creep correction amount is automatically set according to the type (sheet thickness) of sheets to be used for printing. On the other hand, when a "Manual" button 2002 is pressed, manual setting is selected. When a "Adjust correction amount" button 2003 is pressed, the creep correction amount can be adjusted on a sheet type-by-sheet type basis.

Figure 21:
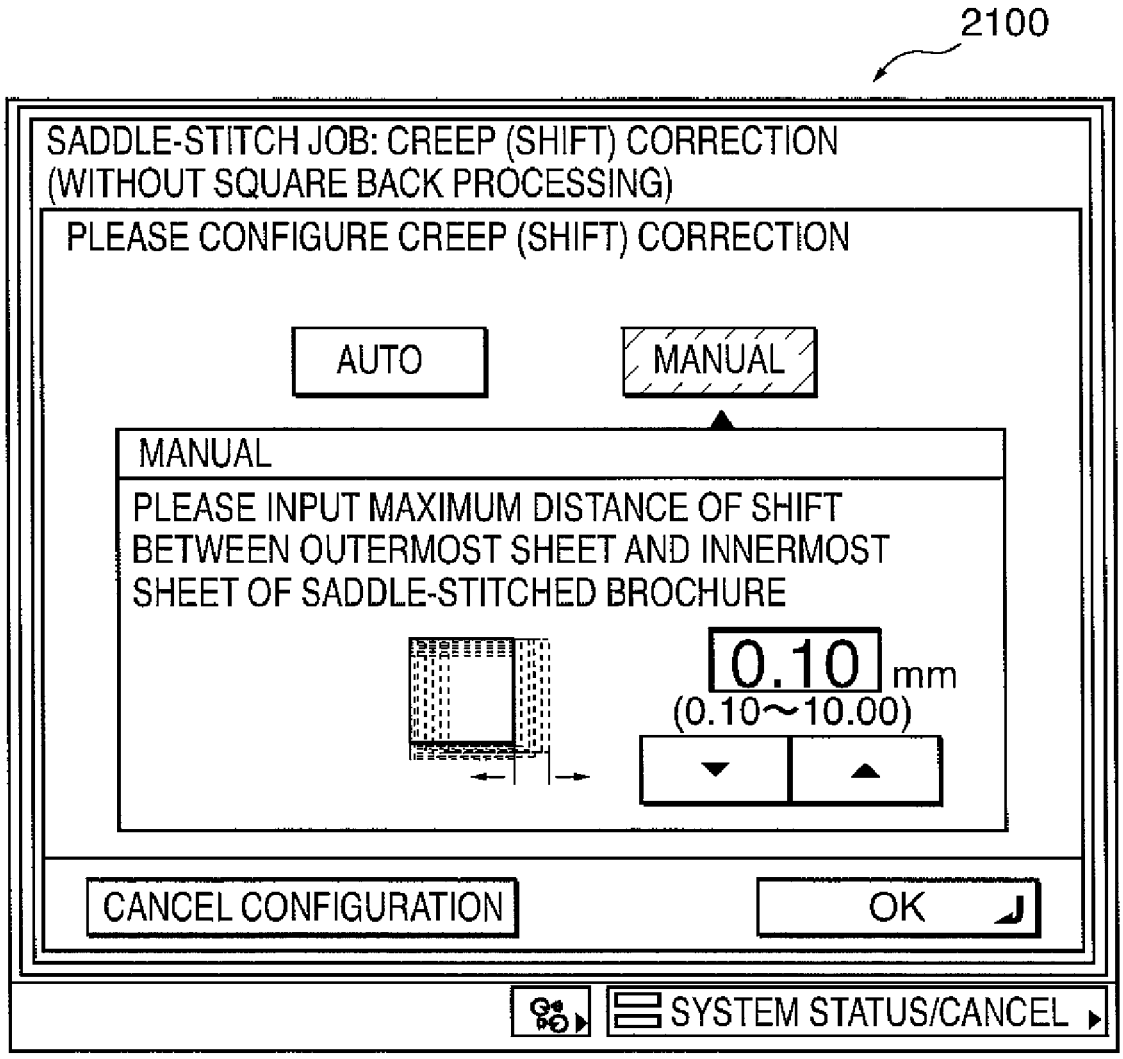
FIG. 21 is a view of an example of a creep correction amount-setting screen (for processing without square back processing).
Figure 22:
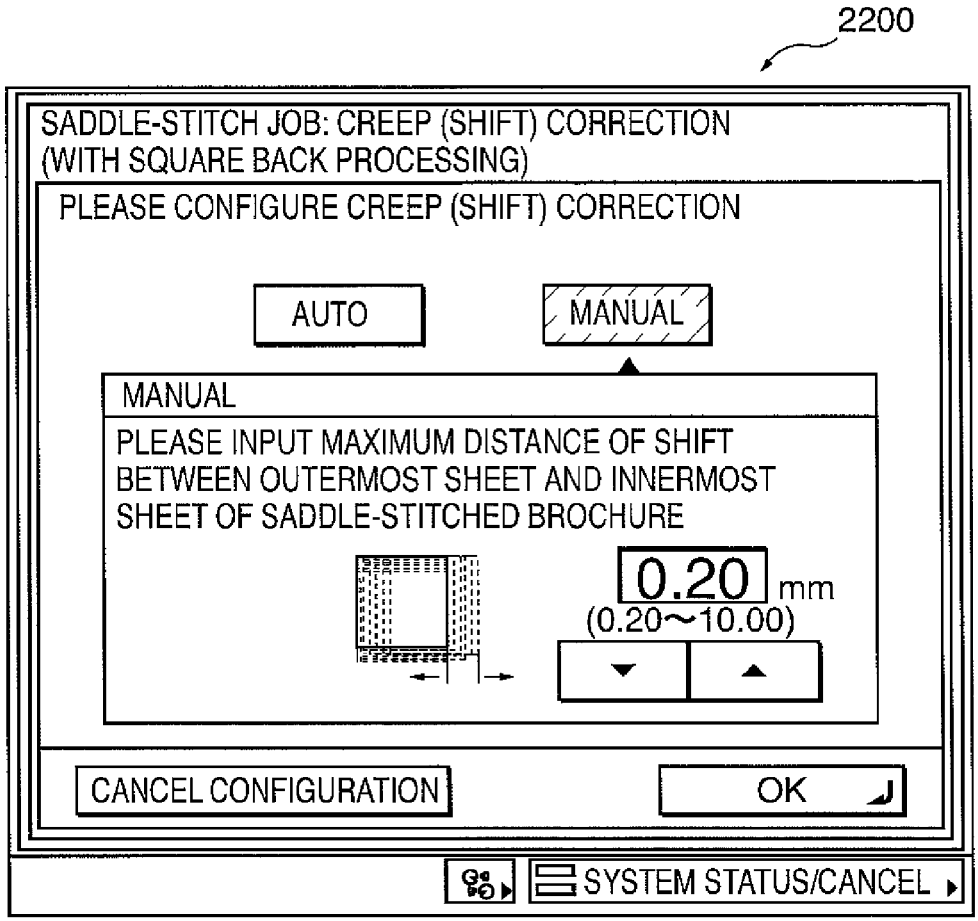
FIG. 22 is a view of an example of a creep correction amount-setting screen (for processing with square back processing).

FIGS. 21 and 22 are views each illustrating an example of a creep correction amount-setting screen displayed when the "Manual" button 2002 in FIG. 20 is pressed, in which FIG. 21 shows a case where square back processing has not been designated, and FIG. 22 a case where square back processing has been designated. On each of the screens shown in FIGS. 21 and 22, the operator can input the amount of shift between an outermost sheet (i.e. a sheet to be used as a cover sheet) and an innermost sheet (i.e. an innermost one of a bundle of sheets folded in half) included in one set of printed sheets for a saddle-stitched brochure. The controller 205 calculates a correction amount (shifting amount) for correcting an image printing position on each sheet, based on the input shift amount and the total number of sheets required for printing of one set of sheets of the saddle-stitched brochure. Then, the controller 205 performs control such that image printing is performed on each side based on the result of calculation. As a consequence, printing is performed such as the inner one of a plurality of sheets to be saddle-stitched has an image printing position located closer to the central part of the sheet.

As shown in FIG. 21, the controller 205 performs control such that "0.10 mm" is displayed as the default value of the creep correction amount in the case where square back processing has not been designated. This value is not allowed in the case where square back processing has been designated, and is a candidate value for a creep correction amount which is allowed only for the case where square back processing has not been designated. The candidate value corresponds to the lower limit value of the creep correction amount. On the other hand, as shown in FIG. 22, the controller 205 performs control such that "0.20 mm" is displayed as the default value of the creep correction amount in the case where square back processing has been designated. This value is a candidate value for a creep correction amount which is allowed for the case where square back processing has been designated, and the candidate value corresponds to the lower limit value of the creep correction amount. It should be noted that this value is allowed even in the case where square back processing has not been designated. As described with reference to FIGS. 11A to 11D, the amount of shift between an inner sheet and an outer sheet in the case where square back processing has been designated is approximately twice as large as that in the case where square back processing has not been designated. Therefore, as shown in FIG. 21, the controller 205 controls the user interface such that the set value of the creep correction amount permitted to be accepted from the operator in the case where square back processing has not been designated falls within a range of 0.10 mm to 10.00 mm. On the other hand, as shown in FIG. 22, the controller 205 controls the user interface such that the set value of the creep correction amount permitted to be accepted from the operator in the case where square back processing has been designated falls within a range of 0.20 mm to 10.00 mm. Thus, the controller 205 performs control such that the allowable range of the set value of the creep correction amount permitted to be accepted from the operator in the case where square back processing has been designated is more restricted than that of the set value of the creep correction amount permitted to be accepted from the operator in the case where square back processing has not been designated.

Figure 23:
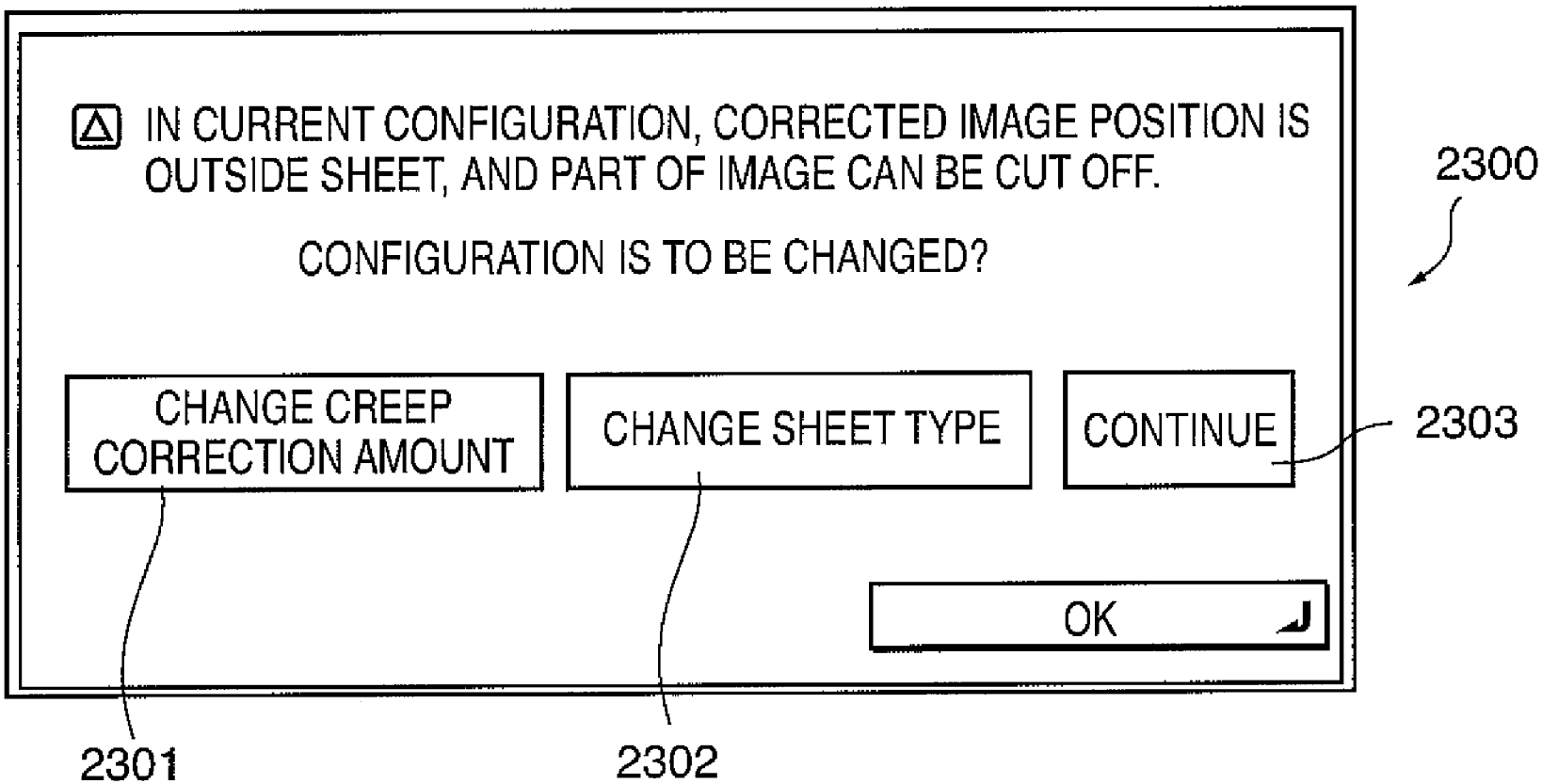
FIG. 23 is a view of an example of a warning screen displayed according to a creep correction amount set on the screens shown in FIGS. 21 and 22.

FIG. 23 is a view of an example of a warning screen displayed according to a creep correction amount set on the screen shown in FIG. 21 or 22.

As described hereinabove, the amount of positional shift between an outer sheet and an inner sheet of a saddle-stitched brochure varies with the sheet count and sheet type (thickness). For this reason, an event can occur in which when image printing is performed based on the creep correction amount set on the creep correction amount-setting screen 2100 in FIG. 21 or on the creep correction amount-setting screen 2200 in FIG. 22, a printed image extends off a sheet and hence the end of the image is not printed on the sheet. Further, even when a maximum value which can be set to the creep correction amount is set, a positional shift can occur between an outer sheet and an inner sheet, depending on a combination of a sheet type and a sheet size. To cope with this event, when an "OK" button is pressed on the screen in FIG. 21 or 22, a comparison is performed between the set value of the creep correction amount and the amount of positional shift between the outer sheet and the inner sheet, which is determined based on the sheet count and the sheet type set to a saddle-stitched brochure, and if the shift amount is larger than the set value of the creep correction amount, the controller 205 causes the touch panel section 401 to display the warning screen 2300 shown in FIG. 23. From this warning screen 2300, the operator can select to change the set value of the creep correction amount, change the type of a sheet (e.g. a cover sheet) used for printing, or continue print processing without changing the settings.

When a "Change creep correction amount" button 2301 is selected, the creep correction amount-setting screen 2100 in FIG. 21 or the creep correction amount-setting screen 2200 in FIG. 22 is displayed, whereby the operator is permitted to change the set value of the creep correction amount. When a "Change cover sheet type" button 2302 is selected, a sheet type-setting screen, not shown, is displayed, whereby the operator is permitted to change the setting of the cover sheet type. When a "Continue" button 2303 is selected, the screen is switched to the saddle-stitch job configuration screen 1200, and the configuration of saddle stitching is completed by depression of the "OK" button.

Next, a creep correction amount-setting process included in the process for setting the processing conditions for a saddle-stitch job will be described with reference to FIGS. 24A and 24B. The process for setting the processing conditions for a saddle-stitch job corresponds to the aforementioned step S1602 in FIG. 16 showing the print processing in the first embodiment. The steps of the print processing except the step S1602 are the same between the present embodiment and the first embodiment.

Figure 24A:
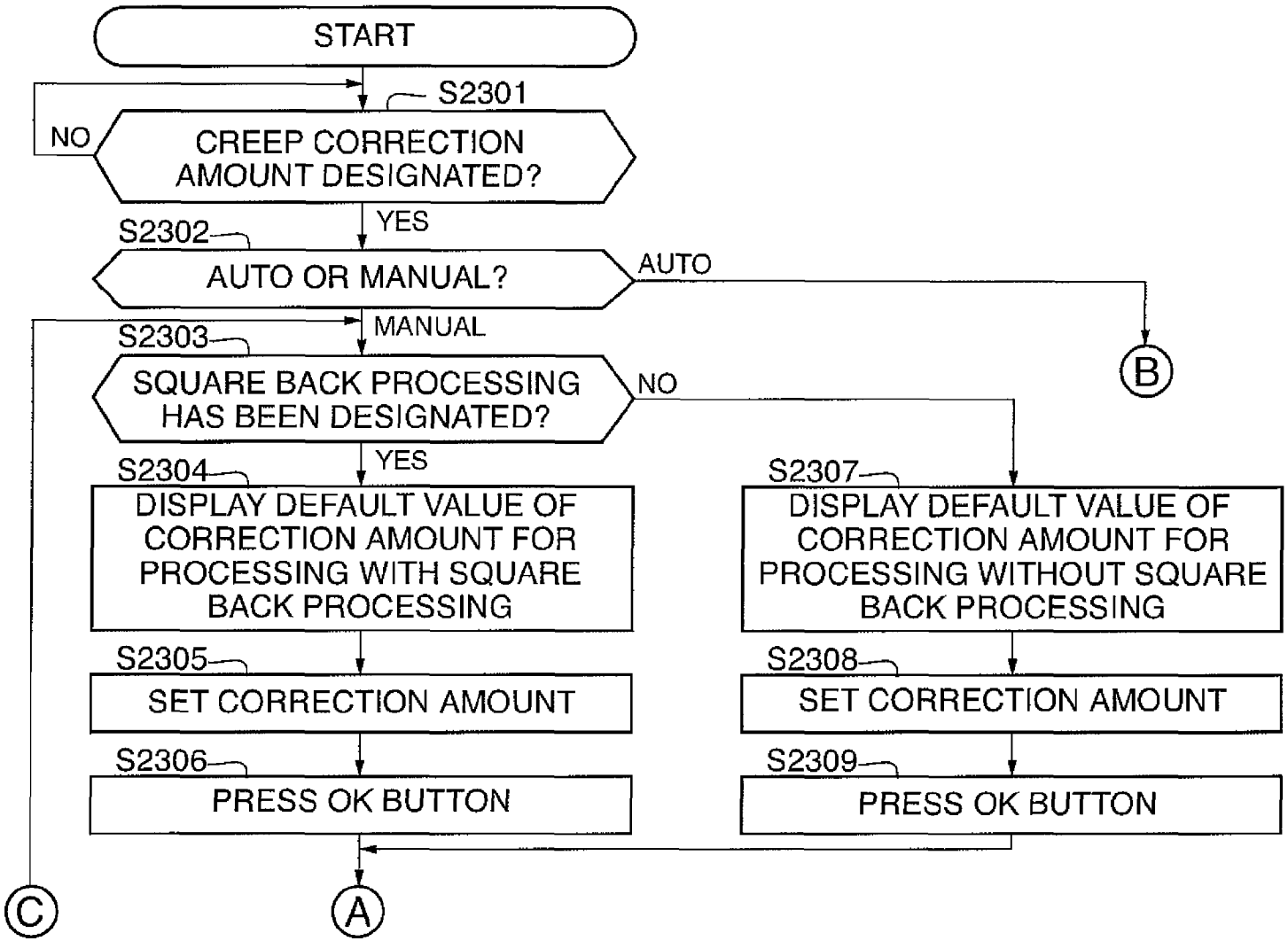
FIGS. 24A and 24B are flowcharts of a creep correction amount-setting process.
Figure 24B:
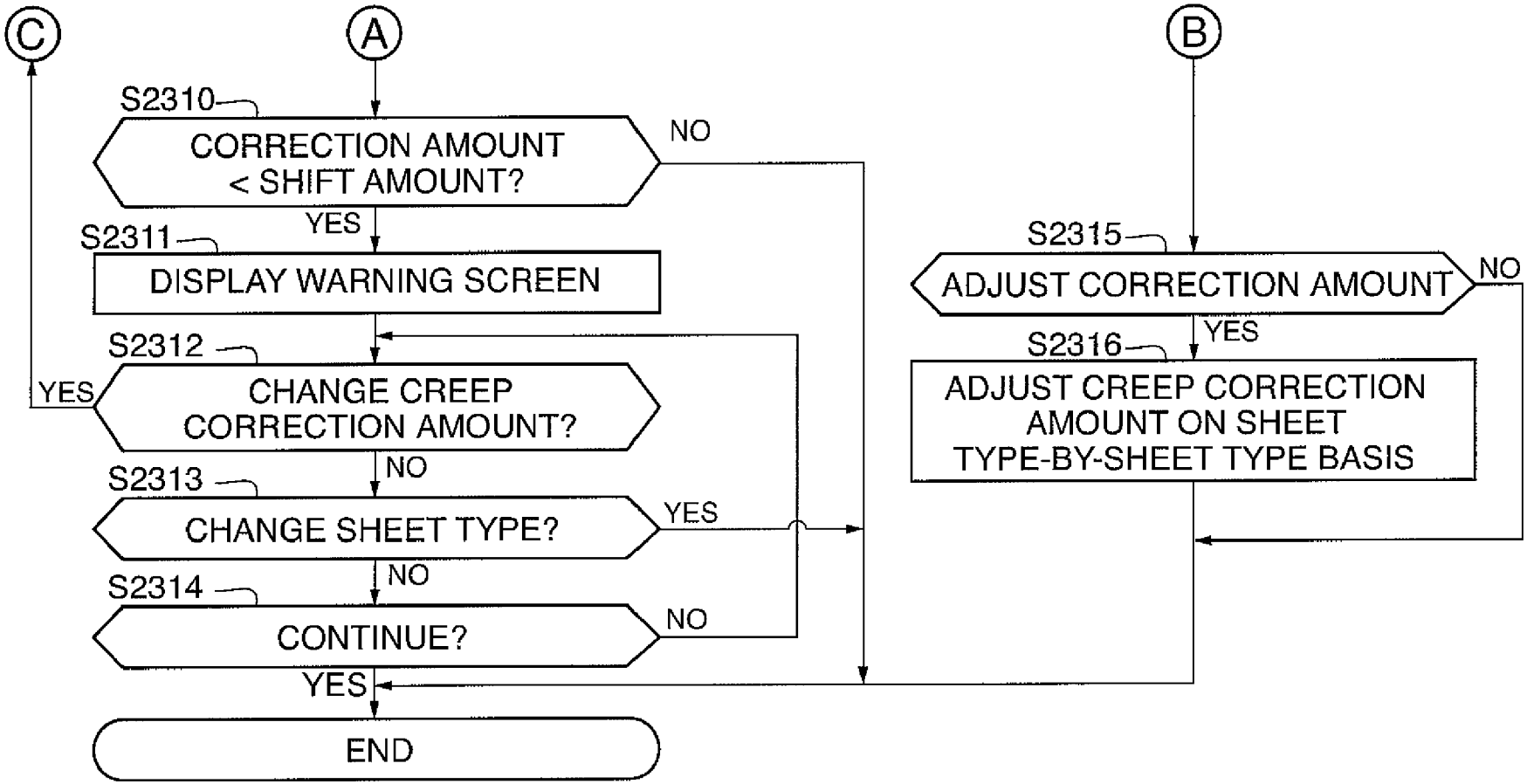

FIGS. 24A and 24B are flowchart of the creep correction amount-setting process.

When the "Correct creep (shift)" button 1203 is selected on the saddle-stitch job configuration screen 1200 (YES to S2301), the controller 205 determines which of the "Auto" button and the "Manual" button has been selected on the creep correction amount adjustment screen 2000 (S2302). If the "Auto" button has been selected, the creep correction amount is automatically set according to the sheet type set in the saddle-stitch job or the number of sheets required for printing. Further, if the "Auto" button has been selected, the controller 205 determines whether or not the "Adjust correction amount" button 2003 appearing in FIG. 20 has been selected (S2315). If the "Adjust correction amount" button 2003 has been selected, it is possible to adjust the creep correction amount on a sheet type-by-sheet type basis (S2316).

On the other hand, if the controller 205 determines in the step S2302 that the "Manual" button has been selected, it determines whether or not square back processing has been designated (S2303). If square back processing has been designated, the default value of the creep correction amount, shown in FIG. 22, in the case where square back processing has been designated is displayed (S2304), and the operator sets a desired creep correction amount (S2305).

On the other hand, if no square back processing has been designated, the default value of the creep correction amount, shown in FIG. 21, in the case where square back processing has not been designated is displayed (S2307), and the operator sets an desired creep correction amount (S2308). In both of the case where square back processing has been designated and the case where no square back processing has been designated, when the "OK" button is pressed (S2306 or S2309), the creep correction amount-setting screen 2100 or 2200 is switched to the saddle-stitch job configuration screen 1200 in FIG. 12. On the other hand, when the "Cancel configuration" button is selected, the screen is switched to the saddle-stitch job configuration screen 1200 without storing the value of the desired creep correction amount set by the operator.

Next, the controller 205 performs a comparison between the set creep correction amount and the shift amount (S2310). If the shift amount is larger than the creep correction amount, the warning screen 2300 shown in FIG. 23 is displayed (S2311). On the other hand, if the creep correction amount is larger than the shift amount, the screen is switched to the saddle-stitch job configuration screen 1200 in FIG. 12. The shift amount used for the comparison with the creep correction amount is calculated based on a setting as to whether to execute square back processing or not, the sheet count, and the sheet type.

Referring to the warning screen 2300 in FIG. 23, processing is made different depending on whether the "Change creep correction amount" button 2301 is selected (S2312), the "Change sheet type" button 2302 is selected (S2313), or the "Continue" button 2303 is selected (S2314). When the "Change creep correction amount" button 2301 is selected, the screen is switched to the creep correction amount-setting screen 2100 in FIG. 21 or 2200 in FIG. 22. When the "Change sheet type" button 2302 is selected, the saddle-stitch job configuration screen 1200 is closed, and the sheet type-setting screen, not shown, is displayed. When the "Continue" button 2303 is selected, the screen is switched to the saddle-stitch job configuration screen 1200 in FIG. 12, and the configuration of saddle-stitch processing is completed.

As described above, in the case of processing a job including saddle-stitch processing, the controller 205 determines whether or not the value of the creep correction amount set by the operator is valid. Then, when the set value is invalid, the controller 205 displays a warning screen to warn the operator, and at the same time control is performed such that the operator is permitted to change the setting, to thereby prevent wasteful printing from being performed for creation of an unintended brochure. In particular, the creep correction amount for a saddle-stitch job is set based on the number of sheets required for printing in the job, the type of the sheets, and the setting as to whether to execute square back processing or not, and therefore it is possible to prevent wasteful printing from being performed for creation of a defective brochure suffering from a shift in image position between outer sheets and inner sheets thereof.

Next, a description will be given of variations of the above-described embodiments.

In FIG. 17, the trimming amount and the shift amount are compared in the step S1709, based on the set values accepted from the operator, and based on the result of the comparison, it is determined whether or not to trim the saddle-stitched brochure by the trimming amount set by the operator. Similarly, in FIGS. 24A and 24B, the creep correction amount and the shift amount are compared in the step S2310, based on the set value accepted from the operator, and based on the result of the comparison, it is determined whether or not to permit print processing to be performed based on the creep correction amount set by the operator. However, these configurations are not limitative.

For example, assume a case where the controller 205 accepts settings for trimming in a saddle-stitch job without square back processing from the operator via the trimming amount-setting screen 1300 in FIG. 13. In this case, the controller 205 performs control such that the trimming amount (allowable trimming value) the operator is permitted to set on the trimming amount-setting screen 1300 is within the range of not smaller than 10.0 mm and not larger than 30.0 mm, and the operator is inhibited from setting a trimming amount outside the range. This control is executed by the controller 205 based on [Rule 1-1] in FIG. 25. On the other hand, when the controller 205 accepts settings for trimming in a saddle-stitch job with square back processing from the operator via the trimming amount-setting screen 1400 in FIG. 14, the controller 205 performs control such that the trimming amount the operator is permitted to set on the trimming amount-setting screen 1400 is within the range of not smaller than 20.0 mm and not larger than 30.0 mm, and the operator is inhibited from setting a trimming amount outside the range. This control is executed by the controller 205 based on [Rule 1-2] in FIG. 25. By performing these control operations, the controller 205 permits the cutter 30 to trim the end of a printout for a saddle-stitch job by a trimming amount within the allowable range, and inhibits the cutter 30 from trimming the same by a trimming amount outside the allowable range.

Further, when the controller 205 accepts a setting for creep correction in a saddle-stitch job without square back processing from the operator via the creep correction amount-setting screen 2100 in FIG. 21, the controller 205 performs control such that the creep correction amount (allowable correction value) the operator is permitted to set on the screen 2100 is within the range of not smaller than 0.10 mm and not larger than 10.0 mm, and the operator is inhibited from setting a creep correction amount outside the range. This control is executed by the controller 205 based on [Rule 2-1] in FIG. 25. On the other hand, when the controller 205 accepts a setting for creep correction in a saddle-stitch job with square back processing from the operator via the screen 2200 in FIG. 22, the controller 205 performs control such that the correction amount the operator is permitted to set on the screen 2200 is within the range of not smaller than 0.20 mm and not larger than 10.0 mm, and the operator is inhibited from setting a creep correction amount outside the range. This control is executed by the controller 205 based on [Rule 2-2] in FIG. 25. By performing these control operations, the controller 205 permits an image forming operation based on the allowed creep correction amount to be carried out in the saddle-stitch job and inhibits execution of image forming operation based on an unallowable creep correction amount.

Thus, the printing system 1000 may be configured such that the controller 205 restricts the operator's operation in advance or performs exclusive control e.g. by displaying invalidity of a touch panel key, according to rules described in the management table 2400 in FIG. 25 so as to inhibit the operator from performing an improper configuration, to thereby realize the above-described functions. This makes it possible to provide the same advantageous effects as provided by the first and second embodiments, without executing the sequential processing shown in FIG. 17 or FIGS. 24A and 24B, thereby contributing to reduction of time required for processing and enhancement of productivity.

The various kinds of processing described in the first embodiment are practiced under the control by the controller 205. Similarly, the various kinds of processing described in the second embodiment are practiced under the control by the controller 205. For example, the control of the trimming amount and the control of the creep correction amount, each of which is applied to a saddle-stitch job, as described above, in accordance with determination as to whether or not to execute square back processing, are both executed by the controller 205. The controller 205 controls the printing system 1000 to execute every step from the step S1601 to the step S1608 in FIG. 16 while performing control according to the four rules in the management table 2400 in FIG. 25. Thus, the various control operations described in the first and second embodiments are carried out by the controller 205.

As described above, the printing system according to either of the above-described embodiments is configured to be capable of performing both the control of the first embodiment (hereinafter referred to as "the first control") and the control of the second embodiment (hereinafter referred to as "the second control"). However, this is not limitative, but it is possible to make various changes and modifications. For example, the printing apparatus and/or the printing system is configured to be capable of executing only one of the first control and the second control. Further, the various kinds of processing and/or control operations, described above in the first and second embodiments, may be executed by a single unit, or alternatively they may be shared by a plurality of units so that the units cooperate to execute them. Furthermore, the aforementioned sheet processing apparatuses may be used as optional equipment for the printing apparatus or provided as standard equipment for the same. The printing system may be also configured such that a unit for performing control corresponding to the control performed by the controller 205 described above is incorporated in a sheet processing apparatus, or a host computer or an external information processing apparatus like a portable terminal apparatus, which is capable of performing data communication with the printing apparatus via the network. This enables the apparatus to function by itself as a system corresponding to the printing system 1000 according to the present embodiment. Although in the above configurations, the controller 205 functions as a unit for performing a plurality of determinations and control operations for square back processing, this is not limitative. For example, some of the determinations and control operations to be performed by the controller 205 in the above-described embodiment may be performed by another unit. Thus, the present invention can be applied not only to a case where an apparatus and/or a system is controlled by a single CPU, but also to a case where a plurality of CPUs cooperate to control an apparatus and/or a system.

Further, although in the present embodiment, two-position stitching using two staples is performed for saddle-stitch processing, this is not limitative, either. For example, the fold of a sheet bundle folded in half may be stitched at three locations using three staples, i.e. three-position stitching may be performed. Further, stitching members other than staples may be used for saddle-stitch processing. For example, a thread may be used to stitch the fold of a sheet bundle folded in half.

As described above, the printing system 1000 is provided with the various configurations. Thus, the printing system is constructed to be capable of performing square back processing, and therefore it is possible to suppress occurrence of the trouble that a saddle-stitched brochure defective in the appearance of a trimmed edge and/or print appearance is inadvertently created.

It is to be understood that the present invention may also be accomplished by supplying a system or an apparatus with a storage medium in which a program code of software, which realizes the functions of the above described embodiment, is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

Further, it is to be understood that the functions of either of the above-described embodiments may be accomplished not only by executing the program code read out by a computer, but also by causing an OS (operating system) or the like which operates on the computer to perform a part or all of the actual operations based on instructions of the program code. In this case, the program code is supplied from a storage medium in which the program code is stored, or is supplied by downloading directly from another computer, a database, or the like, not shown, connected to the Internet, a commercial network, a local area network, or the like.

Although in the above embodiment, the electrophotographic printing is adopted as the printing method executed by the complex apparatus, there is no intention to limit the invention to this. For example, the present invention may be applied to a variety of printing methods such as ink-jet printing, thermal transfer printing, thermal printing, electrostatic printing, and discharge breakdown printing.

The form of the program may be an object code, a program code executed by an interpreter, or script data supplied to an OS (Operating System).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A bookbinding system comprising:

a folding unit configured to perform a folding processing on a sheet bundle comprising a plurality of sheets;

a trimming unit configured to perform a trimming processing for trimming an end of the sheet bundle on which the folding processing is performed;

a setting unit configured to set a trimming amount of the trimming processing based on an input of a user; and a control unit configured to inhibit, when a shift amount between an inner sheet and an outer sheet of the folded sheet bundle occurring at an edge of the folded sheet bundle is greater than the trimming amount set by the setting unit, the trimming unit from performing the trimming processing based on the set trimming amount, and to allow, when the shift amount is not greater than the set trimming amount, the trimming unit to perform the trimming processing based on the set trimming amount.

2. The bookbinding system according to claim 1, further comprising a display unit configured to display a warning screen, wherein the control unit controls, when the shift amount is greater than the set trimming amount, the display unit to display the warning screen.

3. The bookbinding system according to claim 2, wherein the warning screen prompts the user to change a size of the plurality of sheets.

4. The bookbinding system according to claim 2, wherein the warning screen prompts the user to change the set shift amount.

5. The bookbinding system according to claim 2, wherein the warning screen prompts the user to decide whether or not to make the trimming unit perform the trimming processing without changing the set shift amount, and wherein the control unit allows, when the user decides to make the trimming unit perform the trimming processing without changing the set shift amount, the trimming unit to perform the trimming processing based on the set trimming amount.

6. The bookbinding system according to claim 1, further comprising a display unit configured to display a configuration screen through which the trimming amount in the trimming processing is set, wherein the setting unit sets the trimming amount in the trimming processing based on the input of the user which is input through the configuration screen.

7. The bookbinding system according to claim 6, wherein the configuration screen displays a minimum value of the trimming amount which is determined based on the number of the plurality of sheets and a type of the plurality of sheets.

8. The bookbinding system according to claim 1, wherein the shift amount is determined based on the number of the plurality of sheets and a type of the plurality of sheets.

9. The bookbinding system according to claim 1, further comprising a printing unit configured to perform a printing processing on the plurality of sheets, wherein the folding unit performs the folding processing on the sheet bundle comprising the plurality of sheets on which the printing processing is performed.

10. A bookbinding system comprising:

a folding unit configured to perform a folding processing on a sheet bundle comprising a plurality of sheets;

a trimming unit configured to perform a trimming processing for trimming an end of the sheet bundle on which the folding processing is performed;

a setting unit configured to set a trimming amount of the trimming processing based on a input of a user;

a comparing unit configured to compare the trimming amount set by the setting unit with a shift amount between an inner sheet and an outer sheet of the folded sheet bundle occurring at an edge of the folded sheet bundle; and a control unit configured to control whether or not to cause the trimming unit to perform the trimming processing based on the set trimming amount, based on a comparison result of the comparing unit.

11. The bookbinding system according to claim 10, wherein the control unit inhibit, when a shift amount is greater than the set trimming amount, the trimming unit from performing the trimming processing based on the set trimming amount, and to allow, when the shift amount is not greater than the set trimming amount, the trimming unit to perform the trimming processing based on the set trimming amount.

12. The bookbinding system according to claim 10, further comprising a display unit configured to a warning screen, wherein the control unit inhibits the trimming unit from performing the trimming processing based on the set trimming amount based on an input of the user through the warning screen.

13. The bookbinding system according to claim 12, wherein the warning screen prompts the user to change a size of the plurality of sheets.

14. The bookbinding system according to claim 12, wherein the warning screen prompts the user to change the set shift amount.

15. The bookbinding system according to claim 12, wherein the warning screen prompts the user to decide whether or not to make the trimming unit perform the trimming processing without changing the set shift amount, and wherein the control unit allows, when the user decides to make the trimming unit perform the trimming processing without changing the set shift amount, the trimming unit to perform the trimming processing based on the set trimming amount.

16. The bookbinding system according to claim 10, further comprising a display unit configured to display a configuration screen through which the trimming amount in the trimming processing is set, wherein the setting unit sets the trimming amount in the trimming processing based on the input of the user which is input through the configuration screen.

17. The bookbinding system according to claim 16, wherein the configuration screen displays a minimum value of the trimming amount which is determined based on the number of the plurality of sheets and a type of the plurality of sheets.

18. The bookbinding system according to claim 10, wherein the shift amount is determined based on the number of the plurality of sheets and a type of the plurality of sheets.

19. The bookbinding system according to claim 10, further comprising a printing unit configured to perform a printing processing on the plurality of sheets, wherein the folding unit performs the folding processing on the sheet bundle comprising the plurality of sheets on which the printing processing is performed.

20. A bookbinding method comprising:

a folding step of performing a folding processing on a sheet bundle comprising a plurality of sheets;

a trimming step of performing a trimming processing for trimming an end of the sheet bundle on which the folding processing is performed;

a setting step of setting a trimming amount of the trimming processing based on a input of a user; and a control step of inhibiting, when a shift amount between an inner sheet and an outer sheet of the folded sheet bundle occurring at an edge of the folded sheet bundle is greater than the trimming amount set at the setting step, performing the trimming processing based on the set trimming amount at the trimming step, and to allow, when the shift amount is not greater than the set trimming amount, performing the trimming processing based on the set trimming amount at the trimming step.

21. A non-transitory computer-readable storage medium storing a program for causing a computer to execute a bookbinding method, the bookbinding method comprising:

a folding step of performing a folding processing on a sheet bundle comprising a plurality of sheets;

a trimming step of performing a trimming processing for trimming an end of the sheet bundle on which the folding processing is performed;

a setting step of setting a trimming amount of the trimming processing based on a input of a user; and a control step of inhibiting, when a shift amount between an inner sheet and an outer sheet of the folded sheet bundle occurring at an edge of the folded sheet bundle is greater than the trimming amount set at the setting step, performing the trimming processing based on the set trimming amount at the trimming step, and to allow, when the shift amount is not greater than the set trimming amount, performing the trimming processing based on the set trimming amount at the trimming step.

22. A bookbinding method comprising:

a folding step of performing a folding processing on a sheet bundle comprising a plurality of sheets;

a trimming step of performing a trimming processing for trimming an end of the sheet bundle on which the folding processing is performed;

a setting step of setting a trimming amount of the trimming processing based on a input of a user;

a comparing step of comparing the trimming amount set at the setting step with a shift amount between an inner sheet and an outer sheet of the folded sheet bundle occurring at an edge of the folded sheet bundle; and a control step of controlling whether or not to perform the trimming processing based on the set trimming amount at the trimming step, based on a comparison result of the comparing step.

23. A non-transitory computer-readable storage medium storing a program for causing a computer to execute a bookbinding method, the bookbinding method comprising:

a folding step of performing a folding processing on a sheet bundle comprising a plurality of sheets;

a trimming step of performing a trimming processing for trimming an end of the sheet bundle on which the folding processing is performed;

a setting step of setting a trimming amount of the trimming processing based on a input of a user;

a comparing step of comparing the trimming amount set at the setting step with a shift amount between an inner sheet and an outer sheet of the folded sheet bundle occurring at an edge of the folded sheet bundle; and a control step of controlling whether or not to perform the trimming processing based on the set trimming amount at the trimming step, based on a comparison result of the comparing step.

* * * * *